US005353906A

United States Patent [19]

Takamisawa et al.

[11] Patent Number: 5,353,906

[45] Date of Patent: Oct. 11, 1994

[54] METAL BODY DISCRIMINATING APPARATUS

[75] Inventors: Kaihei Takamisawa, Saku; Masakazu Tokumura, Minamisaku, both of Japan

[73] Assignee: Takamisawa Cybernetics Co. Ltd., Tokyo, Japan

[21] Appl. No.: 17,707

[22] Filed: Jan. 15, 1993

Related U.S. Application Data

[63] Continuation-in-part of Ser. No. 757,468, Sep. 10, 1991, Pat. No. 5,199,545.

[30] Foreign Application Priority Data

| | | | |
|---|---|---|---|
| Feb. 28, 1991 | [JP] | Japan | 3-034620 |
| Jul. 27, 1992 | [JP] | Japan | 4-199702 |
| Aug. 13, 1992 | [JP] | Japan | 4-216172 |

[51] Int. Cl.[5] ..... G07D 5/08

[52] U.S. Cl. ..... 194/319

[58] Field of Search ..... 194/317, 318, 319

[56] References Cited

U.S. PATENT DOCUMENTS

| | | | |
|---|---|---|---|
| 4,059,795 | 11/1977 | Mordwinkin . | |
| 4,124,111 | 11/1978 | Hayashi | 194/319 X |
| 4,151,904 | 5/1979 | Levasseur et al. | 194/319 |
| 4,334,604 | 6/1982 | Davies | 194/319 |
| 4,354,587 | 10/1982 | Davis | 194/319 |
| 4,705,154 | 11/1987 | Masho et al. | 194/319 |
| 4,754,862 | 7/1988 | Rawicz-Szczerbo et al. | 194/319 |

FOREIGN PATENT DOCUMENTS

| | | |
|---|---|---|
| 57-98089 | 6/1982 | Japan . |
| 1-25030 | 5/1989 | Japan . |
| 2169429A | 7/1986 | United Kingdom . |
| 2244364A | 11/1991 | United Kingdom . |
| 2253298A | 9/1992 | United Kingdom . |
| 85/04037 | 9/1985 | World Int. Prop. O. . |
| 8600410 | 1/1986 | World Int. Prop. O. . |

*Primary Examiner*—F. J. Bartuska

*Attorney, Agent, or Firm*—Wenderoth, Lind & Ponack

[57] ABSTRACT

In a metal body discriminating apparatus of a simple structure and a high detecting accuracy for discriminating a material, a shape, a size, or the like of a metal body by the magnetical principle, an oscillator which performs the oscillating operation by the resonant operation together with the coil wound like a ring is provided to thereby generate magnetic lines of force in the coil. Changes in frequency and amplitude of an oscillation signal in response to changes in impedance and inductance of the coil by the operation of the eddy current which is generated in the metal body by the magnetic lines of force by relatively moving the metal body into the hollow space of the coil are detected as feature parameters of the metal body. Two or more coils constructing a similar oscillator are arranged at regular intervals and a size of metal body is discriminated from each of the oscillation signals having a phase difference which are obtained when the metal body passes in the coils with a time deviation.

4 Claims, 23 Drawing Sheets

| KIND OF COIN | STANDARD DISCRIMINATING COEFFICIENT RELATING TO CROSS SECTIONAL AREA | STANDARD DISCRIMINATING COEFFICIENT RELATING TO SHAPE | STANDARD DISCRIMINATING COEFFICIENT RELATING TO FREQUENCY |
|---|---|---|---|
| a | $\beta_a$ | $\alpha_a$ | $\eta_a$ |
| b | $\beta_b / \beta_a$ | $\alpha_b / \alpha_a$ | $\eta_b / \eta_a$ |
| c | $\beta_c / \beta_a$ | $\alpha_c / \alpha_a$ | $\eta_c / \eta_a$ |
| ⋮ | ⋮ | ⋮ | ⋮ |

*Fig. 27*

| STANDARD KIND OF COIN | GAUGE DATA RELATING TO CROSS SECTIONAL AREA | GAUGE DATA RELATING TO SHAPE | GAUGE DATA RELATING TO FREQUENCY |
|---|---|---|---|
| a | $G\beta_a = \beta_a / r l$ | $G\alpha_a = \alpha_a / r l$ | $G\eta_a = \eta_a / r l$ |

*Fig. 28*

| KIND OF COIN | GAUGE DATA RELATING TO CROSS SECTIONAL AREA | GAUGE DATA RELATING TO SHAPE | GAUGE DATA RELATING TO FREQUENCY |
|---|---|---|---|
| a | $G\beta_a = \beta_a / r l$ | $G\alpha_a = \alpha_a / r l$ | $G\eta_a = \eta_a / r l$ |
| b | $G\beta_b = \beta_b / r l$ | $G\alpha_b = \alpha_b / r l$ | $G\eta_b = \eta_b / r l$ |
| c | $G\beta_c = \beta_c / r l$ | $G\alpha_c = \alpha_c / r l$ | $G\eta_c = \eta_c / r l$ |
| ⋮ | ⋮ | ⋮ | ⋮ |

t=t1 t=t2 t=t3

METAL BODY DISCRIMINATING APPARATUS

RELATED APPLICATIONS

This is a continuation-in-part application of the copending our application Ser. No. 757,468 filed on Sep. 10, 1991 now Pat. No. 5,199,545 for METAL BODY DISCRIMINATING APPARATUS.

BACKGROUND OF THE INVENTION

The present invention relates to a metal body discriminating apparatus for discriminating a material, a shape, a size, and the like of a metal body such as metal product, metal part, coin, etc. by a magnetic principle.

Hitherto, a case where such a metal body discriminating sensor is used to, for instance, discriminate a coin of an electronic coin detecting apparatus has been know. Such apparatuses have been disclosed in JP-A-59-178592, JP-A-57-98089, JP-B-1-25030, International Publication WO86/00410, U.S. Pat. Nos. 4,462,513, 4,493,411, 4,845,994, and 4,601,380, and the like.

One typical example of such conventional electronic coin detecting apparatuses will be described hereinbelow with reference to FIGS. 30 to 34D. In FIG. 30, a coin 1 which has been put in from a coin input port rolls and moves in the electronic coin detecting apparatus along a guide rail 2 which is inclined to a front side A. The guide rail 2 is formed so as to have width in consideration of a thickness of coin as an object to be detected and is designed so as to adjust a forward inclination angle, to flatten the rolling surface, and the like so that the coin can smoothly roll. The movement in the lateral direction of the coin 1 is restricted by a side wall 3 which is formed perpendicularly to the surface of the guide rail 2 and a side plate (shown by a broken line) 4 which faces the side wall, 3, thereby allowing the coin 1 to roll so as not to be dropped out from the guide rail 2.

The side wall 3 is slightly inclined to the back surface side in a manner such that when the coin 1 rolls along the guide rail 2, the coin 1 always slides with the surface of the side wall 3 by the dead weight of the coin.

Detecting coils 5 and 65 are buried in the side wall 3. A detecting coil 7 is buried in the side plate 4 at a position which faces the detecting coil 5. The detecting coils 5 and 7 are provided in a positional relation such that when the coin 1 passes, it faces almost the central portion. The detecting coil 6 is provided in a positional relation so as to face the peripheral portion of the coin 1.

The detecting coils 5 to 7 correspond to the conventional metal body discriminating sensors. Each of the detecting coils has a structure such that a copper wire 10 is wound around a projecting portion 9 on the inside of a cap-shaped ferrite core (pot core) 8 as shown in FIG. 31. The detecting coils 5 and 6 are buried in the side wall 3 and the side plate 4 so that each projecting portion 9 is directed toward the side of the passage of the coin 1.

Each of the detecting coils 5, 6, and 7 detects the coin 1 by a detecting circuit combined with a bridge circuit as shown in, for instance, FIG. 32. That is, resistors r1 and r2 having predetermined resistance values and an adjusting resistor R1 and an adjusting coil L1 whose values have been preset to proper values are connected to an oscillating circuit 11 of a predetermined frequency. A detecting coil LO (corresponding to the detecting coil 5, 6, or 7) is connected to one side of the bridge circuit, thereby generating a detection signal S from a predetermined output contact.

Thus, as shown in FIG. 33, the detecting coils 5, 6, and 7 driven by the oscillating circuit 11 generate magnetic lines of force (shown by broken lines in the diagram) having predetermined magnetic flux densities on the side of the passage of the coin 1. The bridge circuit is set into an equilibrium state by changes in inductances and impedances of the detecting coils 5, 6, and 7 which are caused due to influences by eddy currents occurring in the coin 1 when the coin 1 transverses in the magnetic lines of force. Thus, the detection signal S indicative of a feature of the coin 1 is generated. The detecting coils 5 and 7 face each other and construct a set of magnetic circuit (corresponding to an inductance LO in FIG. 32), thereby generating magnetic lines of force which perpendicularly transverse the passage of the coin 1. The coin 1 is detected when it passes in the magnetic lines of force. On the other hand, as shown in FIG. 33, the detecting coil 6 generates magnetic lines of force one side of the passage of the coin 1, so that the coin 1 is influenced by the magnetic lines of force from one side.

The coin detecting operation of the apparatus will now be described with reference to FIGS. 34A to 34D. The above diagrams show that when the coin 1 rolls toward the front direction A along the guide rail 2 for a pair of detecting sensors 5 and 7 arranged at predetermined positions for the guide rail 2, the detection signal S which is generated from the detecting circuit changes in accordance with changes in relative positions between the coin 1 and the detecting sensors 5 and 7.

When the coin 1 is away from the above detecting sensors as shown at a certain time point t1, the bridge circuit in FIG. 32 is not in the equilibrium state, so that the detection signal S (refer to FIG. 34B) having the same frequency f and amplitude H as those of the output signal of the oscillator 11 is generated.

As shown at a time point t2, when the front edge portion of the coin 1 approaches between the detecting coils 5 and 7, an eddy current is generated in the approach portion due to an influence by the magnetic lines of force, so that the inductance LO of the bridge circuit changes and the amplitude of the detection signal S changes (refer to FIG. **19*c*). When the coin 1 further progresses between the detecting coils 5 and 7**, a level of eddy current which is generated also gradually increases and the amplitude of the detection signal S also changes in accordance with the change in eddy current.

As shown at a time point t3, when the central portion of the coin 1 coincides with the central portions of the detecting coils 5 and 7, the eddy current which is generated in the coin 1 becomes maximum and the amplitude of the detection signal S becomes minimum in accordance with the adjusting resistor R1 and the coil L1 (refer to FIG. 34D).

On the contrary, when the coin 1 is away from the detecting coils 5 and 7, in a manner similar to the case shown in FIG. 34C, the amplitude of the detection signal increases. After a time point t4 when the coin 1 is completely away from the detecting coils 5 and 7, the magnetic lines of force by the detecting coils 5 and 7 are not gradually influenced by the coin 1. The amplitude of the detection signal S finally approaches the amplitude of the output signal of the oscillating circuit 11 in a manner similar to the case shown in FIG. 34B.

On the other hand the detecting circuit regrading the detecting coil 65 also generates a detection signal S which changes in accordance with an overlap area of the detecting coil 6 and the coin 1 in a manner similar to the above case.

The detection signals S and s are analyzed and a diameter, a thickness, a material, a deforming state, and the like of the coin are judged from change patterns and minimum amplitude values of the detection signals S and s, thereby discriminating a denomination, a pseudo coin, and the like.

The detection signal S which is generated from the detecting circuit using the detecting coils 5 and 7 is a signal which is effective to judge the size, material, and thickness of the coin. The detection signal s which is generated from the detecting circuit using the detecting coil 6 is effective to judge the thickness and diameter of the coin.

However, the metal body discriminating sensors comprising the detecting coils and the metal body discriminating apparatus such as a coin detecting apparatus or the like using such sensors have the following problems.

A metal body such as a coin or the like has a structure such that the metal body moves the front surfaces of the detecting coils while rolling the guide rail. If dusts or dirts have been deposited onto the guide rail due to an installing environment of the apparatus or with the elapse of time, however, the metal body doesn't smoothly roll on the guide rail but moves while jumping. In such a case, there is a problem such that the opposite positional relation between the metal body and the detecting coils is deviated from the normal state and the detection signals are distorted and an error occurs in the discrimination. That is, the guide rail functions as a reference surface to move the metal body such as a coin or the like and there is a drawback of the principle such that when the position of the metal body is deviated from the reference surface, the measurement cannot be performed at a high accuracy.

Consequently, for instance, the maintenance to periodically clean the inside of the apparatus or the like becomes complicated and a cleaning apparatus or the like needs to be additionally provided.

Further, it is necessary to slide a coin or the like with the side wall 3 in order to smoothly move the coin or the like along the guide rail and to stabilize the distance between the coin or the like and the detecting coil under a predetermined condition by making the passing line constant when the coin or the like passes through the detecting coils. For this purpose, it is necessary to finely adjust an inclination angle of the guide rail 2 to the front side and an inclination angle of the side wall 3 to the back surface side. Since the moving characteristics of the coin or the like also change due to a difference between the material of the guide rail 2 and the material of the side wall 3, those inclination angles need to be adjusted.

There is a difference between the intensities of the magnetic lines of force which are generated from the detecting coils 5 and 7 which face each other as shown in FIG. 33 due to a difference of the opposite distance between the detecting coils 5 and 7. Therefore, an assembling accuracy of the side wall 3 and the side plate 4 need to be held constant. In addition, it is required to improve the mechanical accuracy to improve the burying accuracies of the detecting coils 5 and 7 into the side wall 3 and the side plate 4. It is, however, difficult to keep such a mechanical accuracy constant and it is necessary to frequently execute the adjustment. Particularly, since the apparatus has a structure such that if a deformed coin or the like has choked on the way of the guide rail, it is necessary to perform a procedure such that the side plate e4 is detached and, after that, the coin or like is eliminated or the like, so that there is a tendency such that the assembling accuracy of the side wall 3 and the side plate 4 gradually deteriorates. Since such a deterioration of the mechanical accuracy directly exerts an influence on the characteristics of the detection signals, the absolute measuring accuracy is low. For instance, in the case of the coin detecting apparatus to discriminate Japanese coins, the number of kinds of coins is generally set to up to four kinds. This is because an adjusting device, a differential amplifier, and a comparator are needed every denomination as will be obviously understood from FIG. 8 in JP-A-61-262990.

As mentioned above, in the case of realizing the metal body discriminating apparatus such as a coin detecting apparatus by using the conventional metal body discriminating sensors, to improve the detecting accuracy, it is extremely important to improve the mechanical accuracy of the apparatus. There are many problems to be solved such that each apparatus must be individually adjusted, the maintenance is complicated, and the like.

SUMMARY OF THE INVENTION

It is an object of the invention to provide a novel metal body discriminating apparatus in which a remarkable high detecting accuracy is obtained, a structure is simple and cheap, and the mechanical maintenance can be made almost unnecessary.

Still another object of the invention is to provide a metal body discriminating apparatus for discriminating a coin which can cope with many denominations by a simple circuit construction.

To accomplish the above objects, the invention provides a metal body discriminating apparatus for magnetically discriminating a metal body to be measured.

To accomplish the above objects, according to the invention, there is provided a metal body discriminating apparatus comprising: a self-oscillator for executing an oscillating operation by a resonant operation together with a coil wound like a ring; a frequency detecting circuit to detect a frequency of an AC signal which is generated in the oscillator; and a detecting circuit to detect an envelope of the AC signal, wherein changes in frequency and amplitude of the AC signal in association with changes in impedance and inductance of each coil due to the operation of an eddy current which is generated in the metal body by magnetic lines of force which are generated in the coils by relatively moving the metal body in the hollows of the coils are detected by the frequency detecting circuit and the detecting circuit, thereby discriminating a material of the metal body from the frequency change and shape of the metal body from the amplitude change of the envelope.

To accomplish the above object, according to the invention, there is also provided a metal body discriminating apparatus comprising; a self-oscillator in which at least two or more coils which are wound like rings are arranged so that the adjacent coils re set in parallel at a predetermined interval and the oscillating operation is performed by the resonant operation together with each coil; a frequency detecting circuit to detect a frequency of an AC signal which is generated in the oscillator; and a detecting circuit to detect an envelope of the AC signal, wherein changes in frequency and amplitude of the AC signal in association with changes in impedance and inductance of each coil due to the operation off an eddy current which is generated in the metal body by magnetic lines of force which are generated in the coils by relatively moving the metal body in the hollows of the coils are detected by the frequency detecting circuit and the detecting circuit, and the features of the signals which are generated from each frequency detecting circuit and the detecting circuit with phase deviations by deviating the arranging positions of the coils or the features which are derived by a combination are analyzed, thereby discriminating a material and a shape of the metal body.

The above-described two coils or more are not independently formed, but two winding portions or more which are electrically connected in series are formed at a predetermined interval, thus realizing a single coil substantially constituted by two coils or more connected in series. In addition, a coin to be detected is caused to pass through the hollow portions of these winding portions. Furthermore, a self-oscillator which self-oscillates in cooperation with the coil is connected to the two ends of the single coil so that changes in the oscillation frequency and envelope amplitude of the self-oscillator which are caused when a coin to be detected passes through the hollow portions of the winding portions are detected. With this detection, the feature information, of the coin, which are effective in denomination discrimination is obtained, thereby performing denomination discrimination processing.

In addition, the metal body discriminating apparatuses having these arrangements incorporate compensation control means for performing compensation to always obtain a predetermined detection precision even if the respective components constituting the above-described coil, self-oscillator, frequency detecting circuit, and envelope detecting circuit, and the like undergo characteristic changes due to changes over time or changes in external environment.

With the above structure, the magnetic flux densities of the magnetic lines of force which are generated in the hollows of the coils become uniform and the metal body as an object to be measured is moved into the uniform and the metal body as an object to be measured is moved into the uniform magnetic lines of force by insertion, penetration, or the like. Therefore, even if there is a relative positional deviation between the coil and the metal body, the measuring accuracy is not influenced, and the high measuring accuracy is stably obtained.

Therefore, there is eliminated the drawback such that the relative positional relation between the metal body and the detecting coils directly exerts an influence on the measuring accuracy as in the case of using the conventional detecting coils, by merely moving a metal body to be measured into the hollow of the coil of the metal body discriminating sensor of the invention, the high measuring accuracy is obtained. For instance, by merely dropping a metal body to be measured into the hollow of the coil, the high measuring accuracy is obtained. The means such as a guide rail or the like for making the relative positional relation between the metal body and the coil constant in the coin detecting apparatus as a convention example and the means for finely adjusting the inclination of the guide rail to stably move the metal body or the like are unnecessary.

The coil as a metal body sensor has an extremely simple structure and is cheap and hardly has a mechanical adjusting portion and is not also influenced by a environmental difference or the like, so that a maintenance free structure can be realized.

The circuit to extract feature parameters of the metal body as changes in impedance and inductance of the coil is extremely simple. Even if the circuit is combined with the metal body sensor, a remarkable simple apparatus of a small size and a light weight can be realized.

Further, in the case where two or more coils are arranged at a predetermined interval along the passing path of the metal body, if the measurement is executed by setting the interval between the adjacent coils to a predetermined value for a size such as a diameter or the like of the metal body as an object to be measured, when the metal body passes in each coil, a change in detection signal by changes in inductance and impedance of each coil is caused with the phase deviation in terms of the time. The size such as a diameter or the like of the metal body can be discriminated from the deviations of the detection signals.

The shape of the hollow portion which is formed in the space of the coil by the winding of the coil is properly changed as necessary in accordance with a shape or the like of the metal body as an object to be measured. All of the shapes of the hollow portions are incorporated in the invention.

It is preferable to set the hollow portion to the minimum area and shape which are necessary for the metal body to pass in the hollow portion in order to improve the measuring accuracy.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

FIG. 27 is a table showing gauge data stored in an EEPROM arranged in the compensation control unit;

FIG. 28 is a table showing other forms of gauge data stored in the EEPROM arranged in the compensation control unit;

DETAILED DESCRIPTION OF THE PREFERRED EMBODIMENTS

Figure 1:
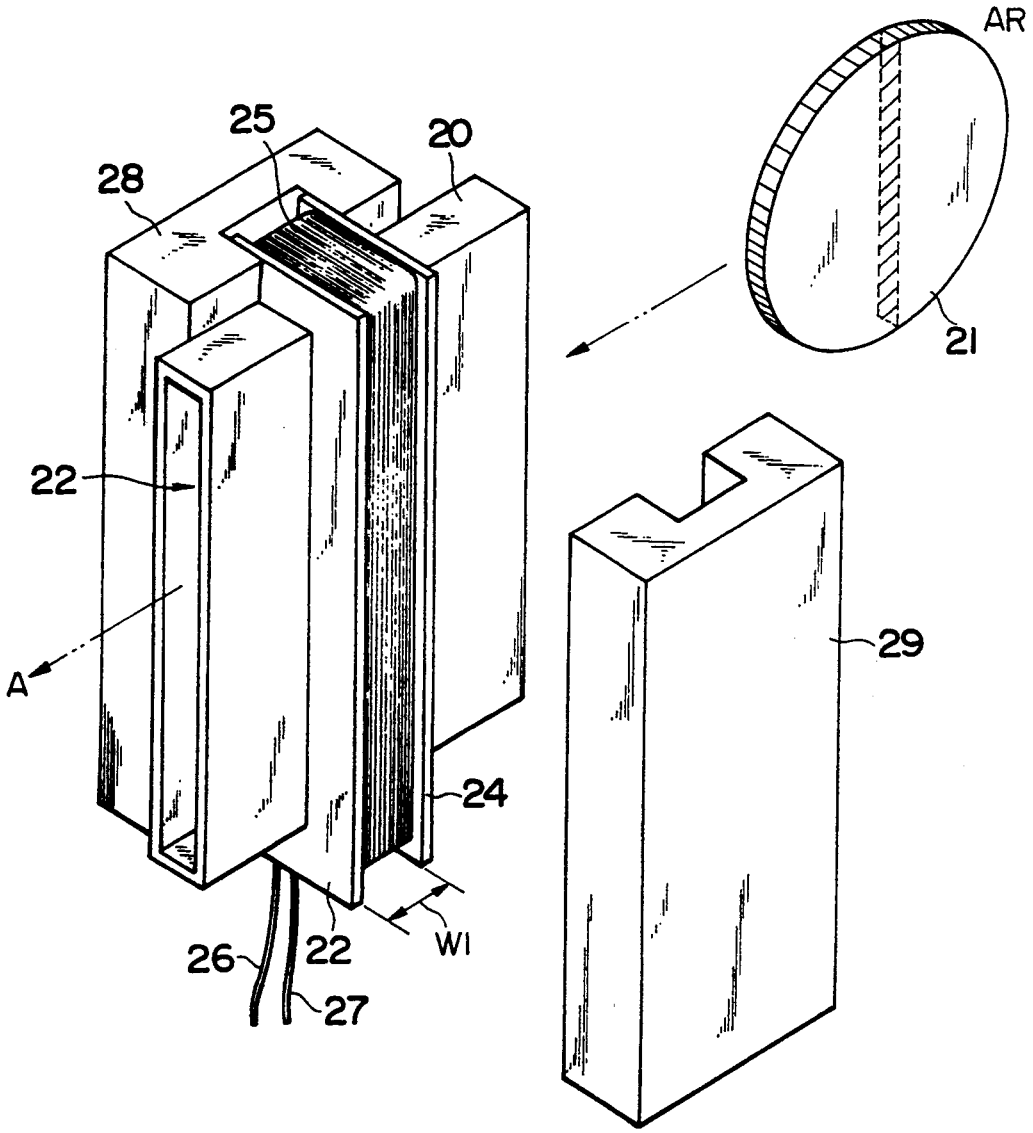
FIG. 1 is a perspective view showing a structure of a metal body sensor which is used in a metal body discriminating apparatus of an embodiment according to the present invention.

FIG. 1 shows a structure of a metal body discriminating sensor of an embodiment.

In FIG. 1, reference numeral 20 denotes a column body which has a hollow hole 22 to penetrate a metal body 21 such as a coin or the like and is molded by plastics or the like. A pair of flange portions 23 and 24 are integratedly formed on the outside wall of the column body 20 so as to be almost in parallel at a predetermined interval W1.

Reference numeral 25 denotes a coil. A relatively thin copper wire which has been coated and insulated is wound by only a predetermined number of turns T around the outside wall of the column body 20 sandwiched by the flange portions 23 and 24, thereby forming the coil 25. Both ends 26 and 27 of the copper wire of the coil are extended to the outside.

Reference numeral 28 denotes a U-shaped core made of ferrite or the like and is assembled by fitting a concave portion to the outside walls of the flange portions 23 and 24. Although the diagram shows an exploded state, a core 29 of the same material and shape as those of the core 28 is fitted to the outside walls of the flange portions 23 and 24 in a manner similar to the core 28, so that the cores 28 and 29 are assembled so as to face each other.

Figure 2:
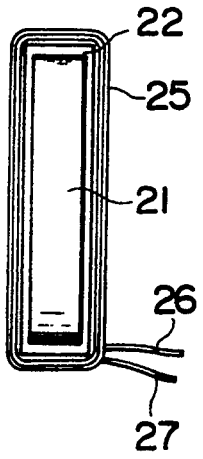
FIG. 2 is an explanatory diagram showing a positional relation between a coil of the metal body discriminating sensor and a metal body in the embodiments according to the present invention.

A shape of the hollow hole 22 is designed so as to have a similar shape which is slightly larger than a cross section AR (shown by a hatched region in the diagram) in the radial direction of the metal body 21 as an object to be measured. As shown in FIG. 2, therefore, the metal body 21 can pass through the hollow hole 22 while keeping a slight gap. The hollow hole 22 is provided for allowing the metal body 21 to pass through the inside of the coil 25. The hollow hole 22 is not provided to specify the passing position of the metal body 21 to the coil 25 at a high mechanical accuracy when the metal body 21 passes in the hollow hole 22 but is provided to simply guide the metal body 21.

Figure 3:
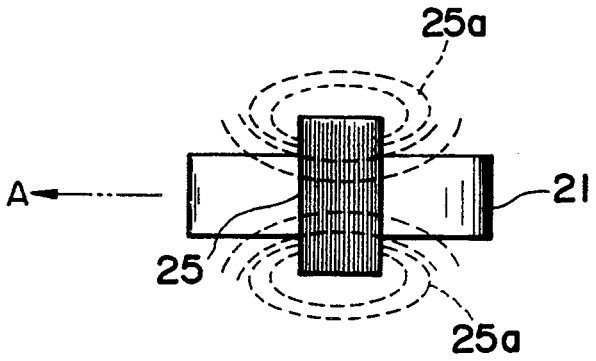
FIG. 3 is an explanatory diagram showing a measuring principle of the metal body discriminating apparatus according to the present invention.

The metal body discriminating sensor supplies an AC signal, which will be explained hereinlater, between both ends 26 and 27 of the winding of the coil 25 by the connection of a self-oscillator which performs self-oscillation in conjunction with the coil 25, magnetic lines of force 25*a* of a predetermined magnetic flux density are generated in the coil 25 as shown in a principle diagram of FIG. 3, and by allowing the metal body 21 to pass in the hollow hole 22, the metal body 21 is subjected to the operation of the magnetic lines of force 25*a*.

Figure 4:
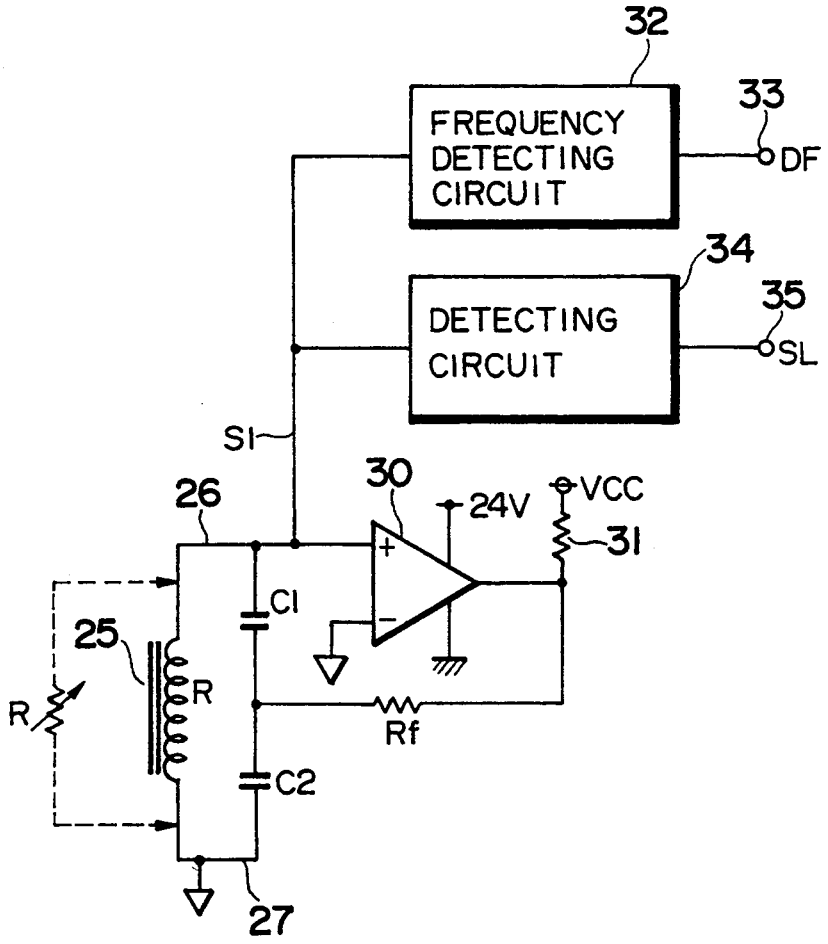
FIG. 4 is a circuit diagram showing a detecting circuit which is applied to the metal body discriminating apparatus according to the present invention.

A detecting circuit which is used for the above purpose will now be described with reference to FIG. 4 also. In FIG. 4, capacitors C1 and C2 are serially connected between both ends 26 and 27 of the coil 25. The terminal 26 is further connected to a non-inverting input contact of a comparator 30. The comparator 30 operates by a power source of a predetermined voltage. An inverting input contact of the comparator 30 is connected to a ground contact. An output contact of the comparator 30 is connected to a common connecting contact P of the capacitors C1 and C2 through a feedback resistor Rf.

When the metal body 21 passes, an inductance and an impedance of the coil 25 are changed due to an influence by a eddy current which is generated in the metal body 21. Therefore, in the diagram, a change in impedance is equivalently shown by reference character R. The inductance (L) of the coil 25 theoretically changes in accordance with the relation expressed by the following equation.

$$L = K \cdot \mu \cdot N^2 \cdot S \cdot l \cdot 10^{-7} \quad [H]$$

where,

K: Nagaoka coefficient

L: Inductance $\mu$: Permeability of the metal body

N: The number of turns of the coil

S: Cross sectional area of the coil l: Length of the coil (corresponding to a width Wl in FIG. 1 )

A circuit comprising the comparator 30, capacitors C1 and C2, resistor Rf, and coil 25 constructs a Colpitts type self-oscillator and generates an AC signal S1 of a frequency and an amplitude which are decided by circuit constants of a tuning circuit comprising the capacitors C1 and C2 and coil 25. The frequency of the AC signal S1 changes in accordance with changes in inductance and impedance R when the metal body 21 passes in the magnetic lines of force which are generated by the coil 25. The signal S1 has characteristic such that the frequency changes in accordance with the permeability of the metal body 21.

Reference numeral 32 denotes a frequency detecting circuit for detecting the frequency of the signal S1 appearing at the terminal 26 and for generating a rectangle signal Df of a frequency equal to that of the signal S1 to an output terminal 33.

Reference numeral 34 denotes an envelop detecting circuit for detecting an envelope of a positive amplitude of the signal S1 and for generating an envelope signal SL to an output terminal 35.

Figure 5A:
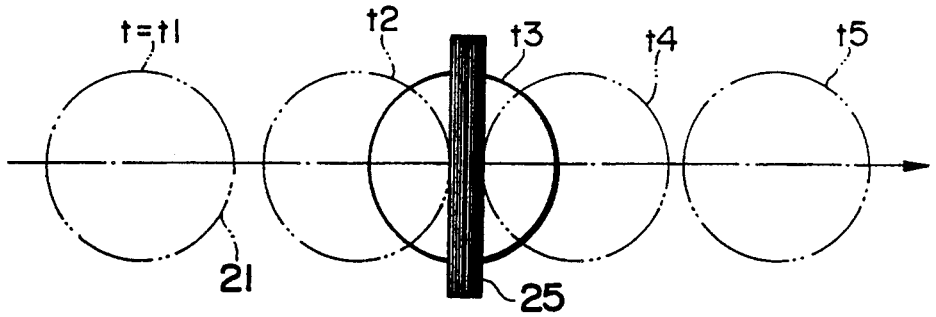
FIG. 5A is an explanatory diagram for explaining the operation of the metal body discriminating apparatus according to the present invention.
Figure 5B:
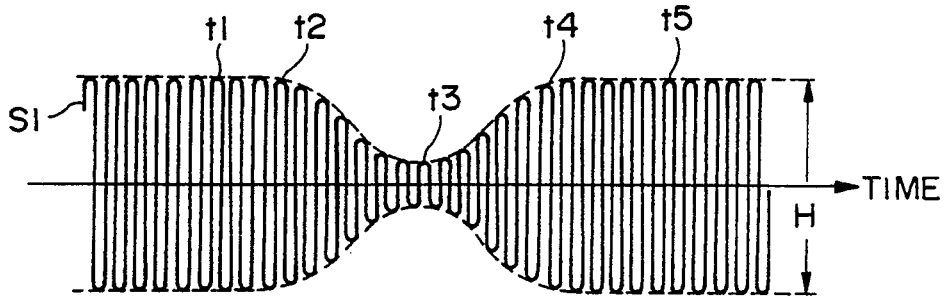
FIG. 5B is a waveform diagram showing an output signal S1 of the coil in correspondence to each timing in FIG. 5A.
Figure 5C:
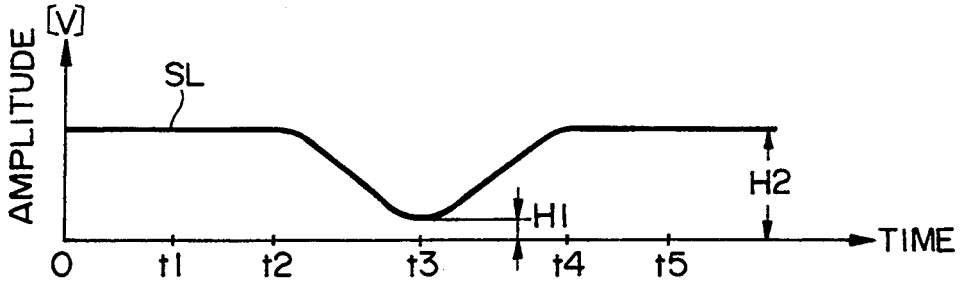
FIG. 5C is a waveform diagram showing an output signal SL of a detecting circuit in correspondence to each timing in FIG. 5A.
Figure 5D:
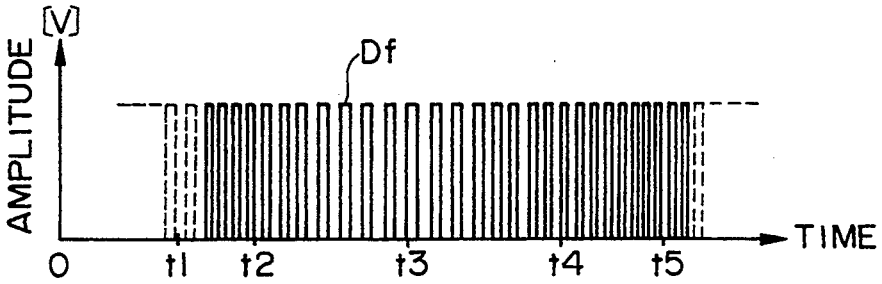
FIG. 5D is a waveform diagram showing an output signal of a frequency detecting circuit in correspondence to each timing in FIG. 5A.

The operation in the case of applying the circuit shown in FIG. 4 will now be described with reference to FIGS. 5A to 5D. FIG. 5B shows a change in signal S1 which is generated in the tuning circuit in the case where the metal body 21 such as a coin or the like penetrates in the hollow portion 22 of the coil 25 of the discriminating sensor along the direction shown by an arrow A as shown in FIG. 5A. FIG. 5D shows a change in the signal Df which is generated to the output terminal 33. FIG. 5C shows a change in the signal SL which is generated to the output terminal 35.

When the metal body 21 is away from the coil 25 as in the case of a state before a time point t1, the metal body is not influenced by the magnetic lines of force, so that the signal S1 of a predetermined frequency and an amplitude in a state in which there is no change in inductance and impedance R is generated in the coil 25. Therefore, the signal SL which is generated from a detecting circuit 34 keeps a predetermined amplitude H2. Similarly, the output signal Df of the frequency detecting circuit 32 appears as a rectangle signal of a predetermined frequency.

As shown at a time point t2, when the front edge portion of the metal body 21 enters the hollow portion of the coil 25, an eddy current is generated in the front edge portion due to an influence by the magnetic lines of force. At the same time, the inductance and impedance R of the coil 25 change and the frequency and amplitude of the signal S1 change. Particularly, there are characteristic such that the frequency change is influenced by the permeability of the metal body 21 and the amplitude is influenced by a cross sectional area of the overlap portion of the front edge portion of the metal body 21 and the coil 25.

When the metal body 21 further progresses into the hollow portion of the coil 25, and amount of eddy current which is generated also gradually increases. The changes in frequency and amplitude of the signal S1 also increase in accordance with the change in eddy current. An amplitude of the output signal SL also decreases in accordance with the change in signal S1 and the frequency of the output signal Df also changes. In the embodiment, there is shown the case of the results of experiments using the metal body 21 made of a material having a permeability higher than that of the air. In such a case, as an area of the overlap portion of the metal body 21 and the coil 15 increases, the frequency of the signal S1 decreases. (On the contrary, in the case of performing experiments by using the metal body 21 made of a material whose permeability is lower than that of the air, as such an overlap area of the metal body 21 and the coil 25 increases, the frequency of the signal S1 rises).

As shown at a time point t3, when the central portion of the metal body 21 coincides with the central portion of the coil 25, since the metal body 21 is made of the material of the permeability higher than that of the air, the eddy current which is generated in the metal body 21 becomes maximum, the amplitudes of the signals S1 and SL become minimum, and the frequency of the output signal Df becomes lowest.

As shown in an interval from time point t3 to time point t5, when the metal body 21 is contrarily away from the coil 25, the frequency and amplitude of the signal S1 also change so as to be gradually returned to the original values. When the metal body 21 is completely away from the coil 25, the signal S1 is returned to the original frequency and amplitude (for instance, the frequency and amplitude at a time point t1).

As mentioned above, the amplitude of the output signal SL and the frequency of the output signal Df change in accordance with the material of the metal body 21 and the cross sectional area. By analyzing the signals SL and Df by a predetermined signal processing circuit (not shown), the metal body 21 can be specified in terms of the shape such as size, thickness, and the like and in terms of the material such as a permeability and the like. Thus, the above method can be applied to the coin detecting apparatus or the like.

Figure 6:
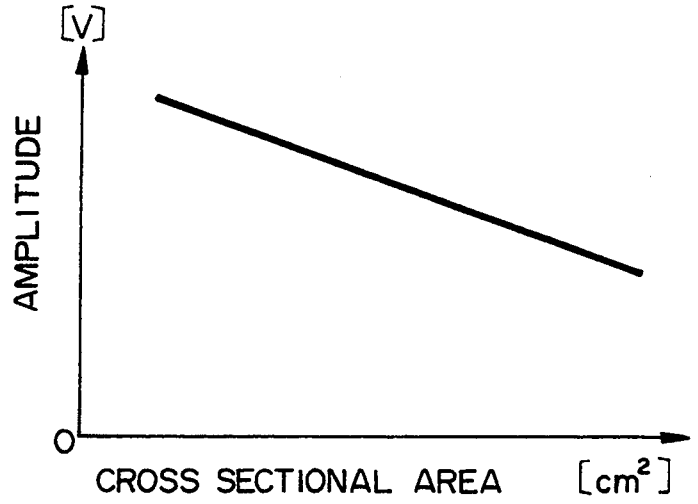
FIG. 6 is an explanatory diagram showing characteristics of a detection signal detected by the metal body discriminating apparatus according to the present invention.
Figure 7:
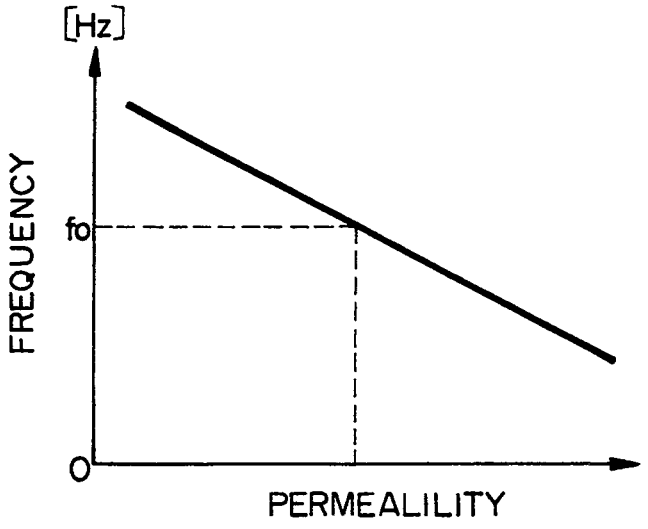
FIG. 7 is an explanatory diagram showing an example of an object having a special shape to be discriminated.

That is, as shown in FIG. 6, the amplitude of the output signal SL decreases as the cross sectional area of the metal body 21 is large. There are also characteristics such that the frequency of the output signal SL decreases as the permeability of the metal body 21 is large. Therefore, as shown in FIG. 5C, a difference between the minimum amplitude H1 and the maximum amplitude H2 of the signal SL is proportional to the diameter and thickness of the coin at a high accuracy. The selection and discrimination of the coin can be realized in terms of the shape on the basis of the change in amplitude of the signal SL. On the other hand, since there is high correlation between the frequency change of the signal Df shown in FIG. 5D and the permeability of the coin, by checking such a frequency change, the coin can be selected and discriminated from a viewpoint of the material. By compoundly processing the above detection data, a discriminating process of a further high accuracy can be realized.

As mentioned above, although the metal body discriminating apparatus according to the embodiment has an extremely simple structure, the metal body to be measured is allowed to pass in the hollow portion of the coil in which the magnetic flux density of the magnetic lines of force which are generated by an AC signal is most stable and the shape and material of the metal body are discriminated from the changes in inductance and impedance of the coil due to a change in eddy current which is generated in the metal body. Thus, the measuring accuracy is remarkably improved as compared with that in the conventional case where the metal body is discriminated by the detecting sensors.

In the case of allowing the metal body to pass in the hollow portion of the coil whose magnetic flux density is uniform, the mechanical accuracy of the positional relation between the coil and the metal body in the hollow portion doesn't exert an influence on the measuring accuracy. It is sufficient to merely allow the metal body to pass in the hollow portion of the coil and there is no need to provide the convention guide rail as a reference surface or the like.

A plurality of feature parameters which are necessary to specify the metal body are detected by the detecting circuit of a simple construction comprising the self-oscillation circuit which performs the resonant operation together with the coil of the discriminating sensor in the embodiment, the frequency detecting circuit, and the detecting circuit. Therefore, in the case of constructing the coin detecting apparatus and other metal body discriminating apparatus, the whole apparatus can be simplified and the light weight and small size can be realized. Further, since there is no adjusting portion, the number of operations for repair, adjustment, and the like can be fairly reduced.

Figure 8A:
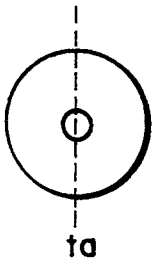
FIG. 8A is a schematic diagram of an example of an object having a special shape which can be discriminated by the present invention.
Figure 8B:
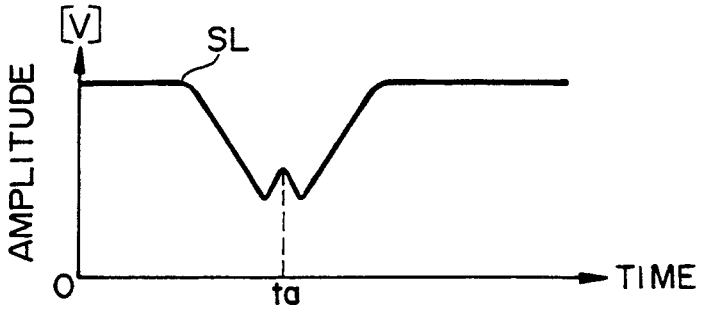
FIG. 8B is an explanatory diagram for explaining a discriminating process in the object to be discriminated in FIG. 8A.

Further, as shown in FIG. 8A, in the case of discriminating a metal body of a special shape having a hole in the central portion like a 5-yen or 50-yen coin which is used in Japan, if the center of the coil 25 overlap with the hole of the coin at a time point ta' a mountain-like amplitude appears in a valley-like portion in which the amplitude of the output signal SL has been reduced as shown in FIG. 8B. The presence or absence of the hole or a size can be discriminated from a magnitude and a time width of the mountain-like amplitude. As mentioned above, not only the outer shape of the metal body can be measured but also the shape worked on the inside can be measured. Many kinds of metal bodies having different shapes can be discriminated. In the embodiment, the cores 28 and 29 have been provided for the coil 215 as shown in FIG. 1. However, the cores 28 and 29 have been provided so that the coil 25 is not influenced by the external magnetic field. If the coil 25 is used in an apparatus which is not influenced by the magnetic field from the outside, the cores 28 and 29 can be also omitted.

Another embodiment will now be described. As shown in FIGS. 9 to 14, a second embodiment has a structure which is derived by combining two detecting circuits each having the construction shown in the first embodiment. That is, in FIG. 9, reference numeral 40 denotes a column body which has a hollow hole 42 to penetrate a metal body 41 such as a coin or the like and is molded by plastics or the like.

A pair of flange portions 43 and 44 are integratedly formed on the outside wall of the column body 40 so as to face each other at a predetermined interval W1. A relatively thin copper wire which has been coated and insulated in wound by only a predetermined number of turns T around the outside wall of the column body 40 sandwiched by the flange portions 43 and 44, thereby forming a first coil 45. Both ends 46 and 47 of the copper wire of the coil 45 are extended to the outside.

Further, a second coil 50 having the same structure as that of the first coil 45 is provided for the column body 40 at a predetermined interval. That is, a flange portion 48 is provided at a predetermined interval W2 from the flange portion 44 and, further, a flange portion 49 is formed at the predetermined interval W1. A relatively thin copper wire which has been coated and insulated is wound by only a predetermined number of turns T around the outside wall of the column body 40 sandwiched by the pair of flange portions 48 and 49, thereby forming the second coil 50. Both fends 51 and 52 of the copper wire of the coil 50 are extended to the outside.

Reference numerals 53 and 54 denote U-shaped cores formed by a ferrite or the like having the same shape although they are separately provided. The core 53 is assembled by fitting the concave portion of the core 53 to the outside walls of the flange portions 43 and 44. The core 54 is assembled by fitting the concave portion of the core 54 to the outside walls of the flange portions 48 and 49.

Figure 9:
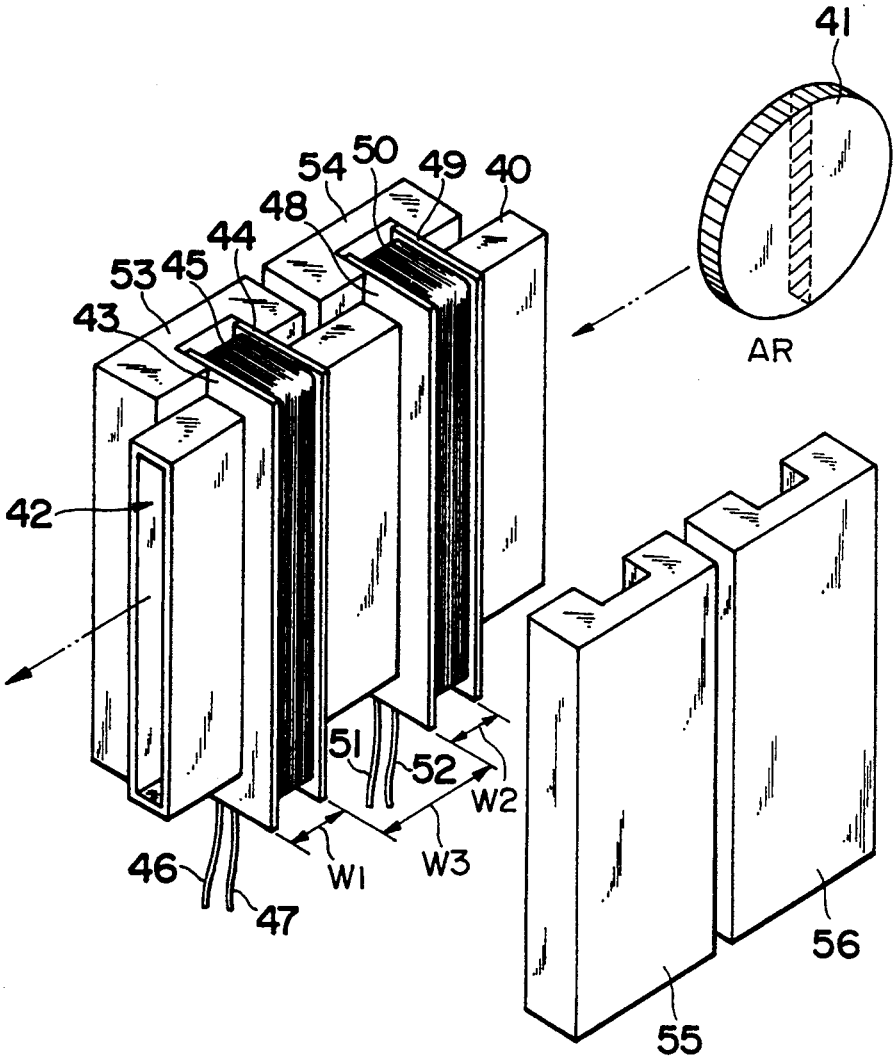
FIG. 9 is a perspective view showing a structure of a metal body sensor which is used in a metal body discriminating apparatus of a second embodiment.

Although FIG. 9 illustrates an exploded state, a core 55 having the same material and shape as those of the core 53 is fitted to the outside walls of the flange portions 43 and 44 in a manner similar to the case of the core 53. A core 56 of the same material and shape as those of the core 54 is fitted to the outside walls of the flange portions 48 and 49 in a manner similar to the case of the core 54.

In the case of using the embodiment to an apparatus such as a coin detecting apparatus for discriminating various kinds of metal bodies having different diameter, the interval W3 is set to a value which is almost equal to a diameter of the metal body of the smallest diameter. For instance, in the case of the coin detecting apparatus for use in Japan, the interval W2 is set a value which is almost equal to a diameter of 1-yen coin having the smallest diameter among 1-yen, 5-yen, 10-yen, 50-yen, 100-yen, and 500-yen coins which are used in Japan.

Figure 10:
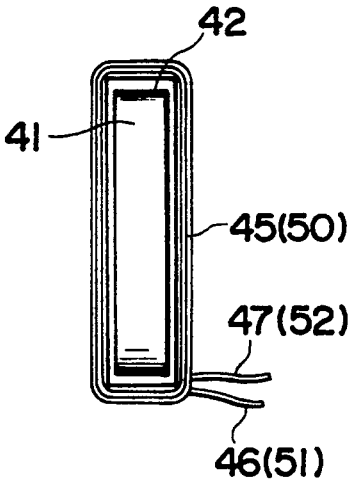
FIG. 10 is an explanatory diagram showing a positional relation between a coil of the metal body discriminating sensor of second embodiment and a metal body.
Figure 11:
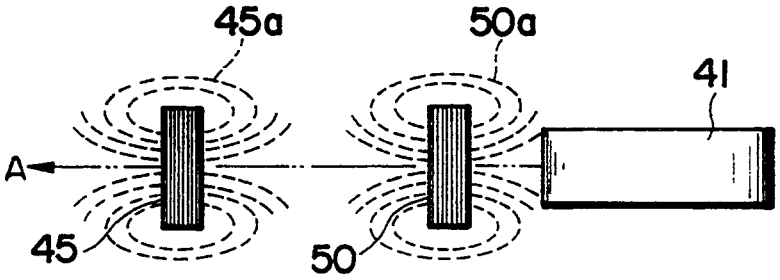
FIG. 11 is an explanatory diagram showing a measuring principle of the metal body discriminating apparatus of the second embodiment.

On the other hand, the hollow hole 42 has been designed to a similar shape which is slightly larger than a cross section AR (shown by a hatched region in the diagram) in the radial direction of the metal body 41 as an object to be measured. Therefore, as shown in FIG. 10, the metal body 41 can pass in the hollow hole 42 while keeping a slight gap. The hollow hole 42 has been provided for allowing the metal body 41 to pass on the inside of the coils 45 and 50. The hollow hole 42 is not provided to specify the passing position of the metal body 41 can pass in the hollow hole 42 while keeping a slight gap. The hollow hole 42 has been provided for allowing the metal body 41 to pass on the inside of the coils 45 and 50. The hollow hole 42 is not provided to specify the passing position of the metal body 41 for the coils 45 and 50 at a high mechanical accuracy when the metal body 41 passes in the hollow hole 42 but is provided to simply guide the metal body 41.

The metal body discriminating apparatus has a detecting circuits of two systems by connecting the detecting circuits each having the same structure as that shown in FIG. 4 to the coils 45 and 50, respectively. As shown in a principle diagram of FIG. 11, magnetic lines of force 45*a* and 50*a* are generated in the coils 45 and 50, respectively, and the metal body 41 is allowed to pass in the magnetic lines of force 45*a* and 50*a*.

Figure 12A:
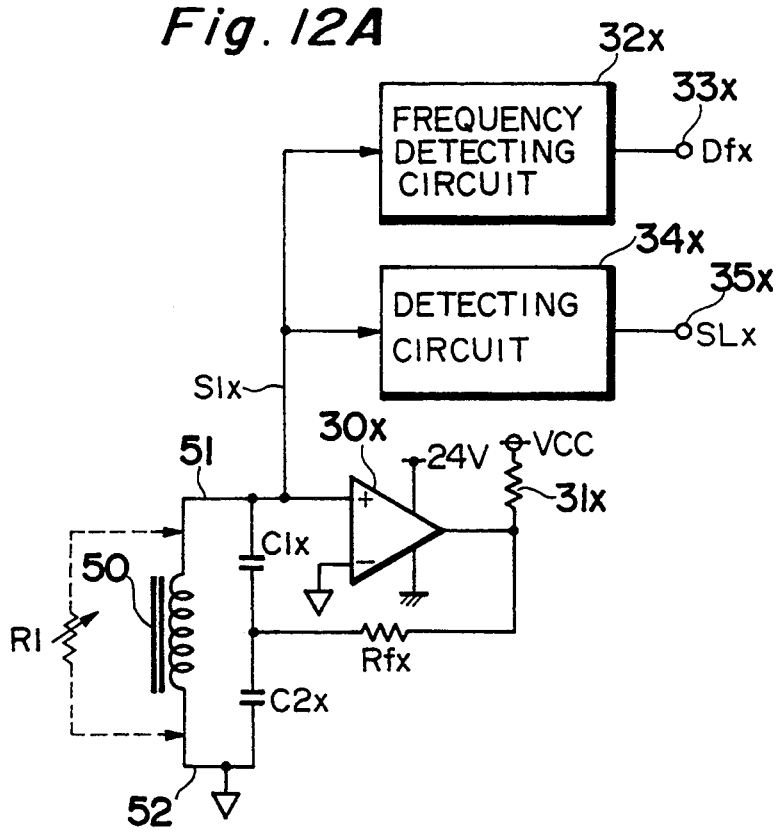
FIG. 12A is a circuit diagram showing one detecting circuit which is used in the metal body discriminating apparatus of the second embodiment.
Figure 12B:
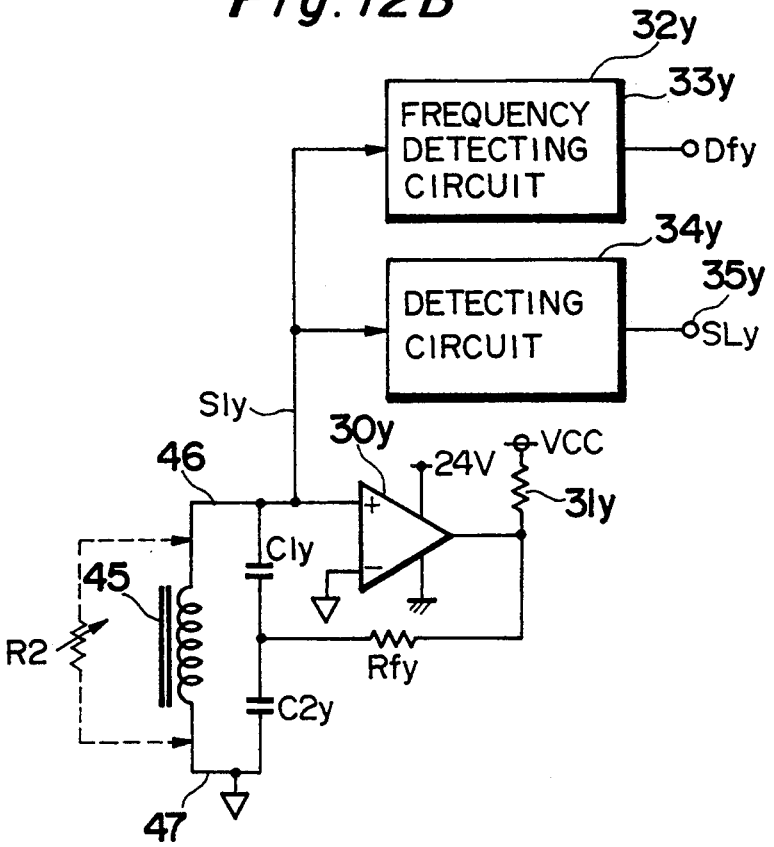
FIG. 12B is a circuit diagram showing the other detecting circuit which is used in the metal body discriminating apparatus of the second embodiment.

FIGS. 12A and 12B show the circuits which are respectively connected to the coils 45 and 50. Reference numeral R1 equivalently shows a change amount of an impedance of the coil 50 which changes due to an influence by an eddy current which is generated in the metal body 41 when the metal body 41 passes in the magnetic lines of force generated by the coil 50. Reference numeral R2 equivalently denotes a change amount of an impedance of the coil 45 which changes due to an influence by the eddy current which is generated in the metal body 41 when the metal body 41 passes in the magnetic lines of force generated by the coil 45. Inductances L of the coils 45 and 50 change as shown by the above equation. Component elements in the corresponding relation with the first detecting circuit and the detecting circuit of FIG. 4 are designated by substantially the same reference numerals except that they are added with a suffix "x" in FIG. 12A. Component elements in the corresponding relation with the second detecting circuit and the detecting circuit of FIG. 4 are designated by substantially the same reference numerals except that they are added with a suffix "y" in FIG. 12B.

Figure 13A:
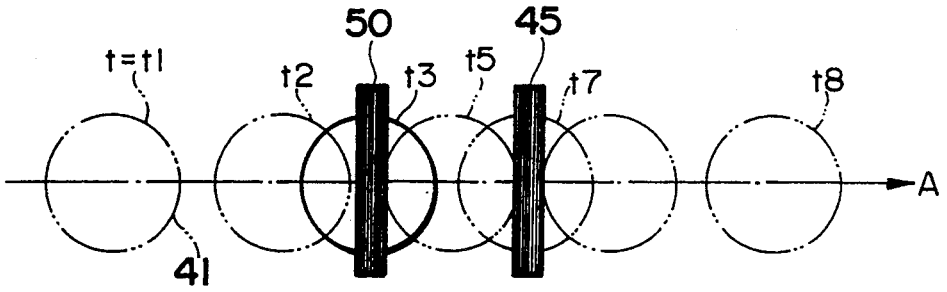
FIG. 13A is an explanatory diagram for explaining the operation of the metal body discriminating apparatus of the second embodiment.

The operation of the metal body discriminating apparatus will now be described with reference to FIGS. 13A to 13F. FIGS. 13B to 13F show waveform changes of AC signals S1*x*' SLx' and Dfx which are generated in the first detecting circuit in FIG. 12A and waveform changes of AC signals S1*y*' SLy' and Dfy which are generated in the second detecting circuit in FIG. 12B in the case where the metal body 41 such as a coin or the like penetrates in the hollow portions of the coils 45 and 50 of the discriminating sensors in the direction of an arrow A as shown in FIG. 13A.

Figure 13B:
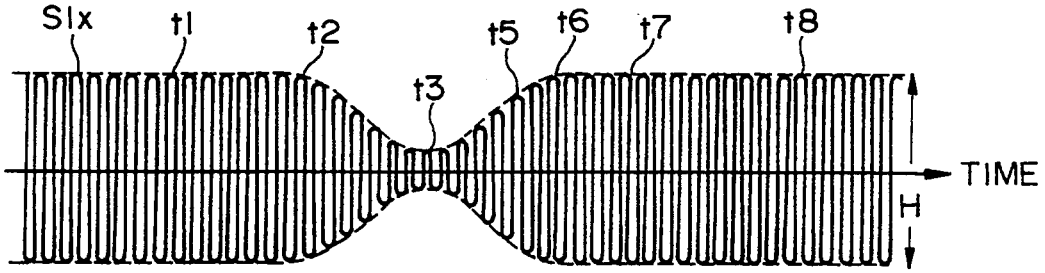
FIG. 13B is a waveform diagram showing a signal S1*x* in correspondence to each timing in FIG. 13A.
Figure 13C:
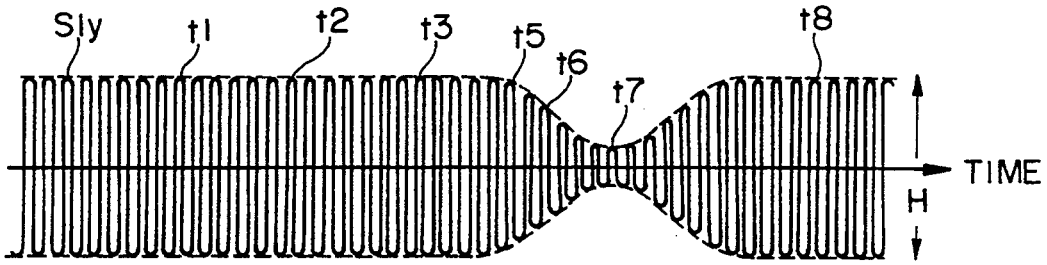
FIG. 13C is a waveform diagram showing a signal S1*ly* in correspondence to each timing in FIG. 13A.

When the metal body 41 is away from both of the coils 50 and 45 as shown in a state before a time point t1' the signals S1*x* and S1*y*' each having the frequency and amplitude which are determined by the inductance of each of the coils 50 and 45 in a state in which the metal body 41 is not influenced by both of the magnetic lines of force are generated to the detecting circuits (refer to FIGS. 13B and 13C). In response to the signals S1*x* and S1*y*' amplitudes of the signals SLx and SLy which are generated from detecting circuits 34*x* and 34*y* are also set to a predetermined value and frequencies of the signals Dfx and Dfy which are generated from frequency detecting circuits 32*x* and 32*y* are also set to a predetermined value.

As shown at a time point t2' when the front edge portion of the metal body 41 enters the hollow portion of the coil 50, an eddy current is generated in the front edge portion due to an influence by the magnetic lines of force, an inductance and an impedance R1 of the coil 50 change, a frequency and amplitude of the signal S1*x* start to change, an amplitude of the signal SLx decreases, and a frequency of the signal Dfx also starts to change. In the case of the metal body 41 made of material whose permeability is higher than that of the air, as shown in the diagrams, the frequency of the signal S1*x* decreases as an area of the overlap portion of the metal body 41 and the coil 50 is large. (On the contrary, in the case of the metal body 41*s* made of a material whose permeability is lower than that of the air, the frequency of the signal S1*x* increases as the overlap area of the metal body 41 and the coil 50 is large).

When the metal body 41 further progresses into the hollow portion of the coil 59, an amount of eddy current which is generated also gradually increases. In response to such a change in eddy current, the frequency and amplitude of the signal S1*x*′ the envelope amplitude of the signal SLx′ and the frequency of the signal Dfx also change.

As shown at time point t3′ when the central portion of the metal body 41 coincides with the central portion of the coil 59, the eddy current which is generated in the metal body 41 becomes maximum, the amplitudes of the signals S1*x* and Dfx become minimum, and the frequency of the signal Dfx becomes minimum, and the frequency of the signal Dfx becomes minimum.

After a time point t3′ the metal body 41 is gradually away from the coil 50. On the contrary, the amplitudes and frequencies of the signals S1*x*, SLx, and Dfx are gradually returned to those at the time point t1.

When the metal body 41 subsequently moves and the front edge portion of the metal body 41 overlaps with the coil 45, amplitudes and frequencies of signals S1*y*′ and Dfy of the second detecting circuit regarding the coil 45 start to change.

Figure 14:
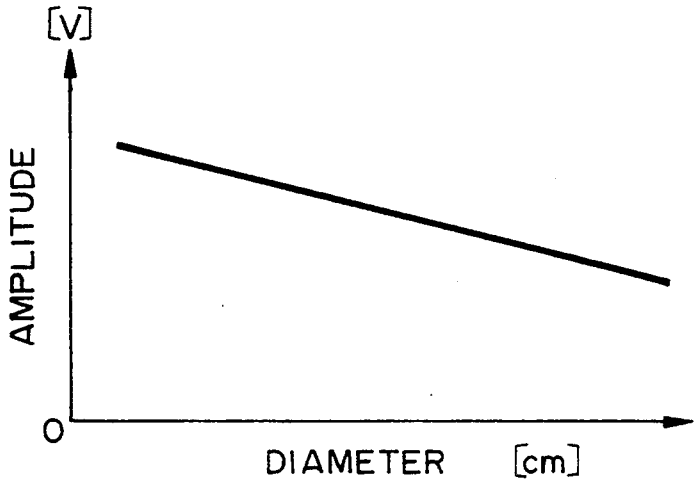
FIG. 14 is a characteristic diagram of a detection signal detected by the metal body discriminating apparatus of the second embodiment.

As shown at a time point t5, when an area of the overlap portion of the front edge portion of the metal body 41 and the coil 45 is equal to an area of the overlap portion of the rear edge portion of the metal body 41 and the coil 50, envelope amplitudes (indicated by ΔH) OF THE SIGNALS SLx and SLy are equalized. In the embodiment, a state in which the envelope amplitudes are equal is detected such that the signals SLx and SLy just cross, thereby detecting the amplitude ΔH at that time point. As shown in FIG. 14, since there are correlation characteristics such that the amplitude ΔH is inversely proportional to the diameter of the metal body 41, the data off the correlation characteristics is previously stored into a memory circuitry (not shown) such as a reference table or the like. By reading out such data in correspondence to the amplitude ΔH, the diameter of the metal body 41 is discriminated.

Further, after a time point when the metal body 41 has completely been away from the coil 50 as shown at a time point t6′ the amplitudes and frequencies of the signals S1*x*′ SLx′ and Dfx of the first detecting circuit are returned to those at the time point t1.

On the other hand, when the metal body 41 gradually progresses into the coil 45 and the overlap portion of the metal body 41 and the coil 45 becomes maximum as shown at a time point t7′ the amplitude of the signal S1*y* is set to the minimum value and the frequency also becomes minimum. In response to them, the amplitude of the signal SLy of the second detecting circuit is set of the minimum value H1 and the frequency of the signal Dfy becomes lowest.

After a time point t7′ since the metal body 41 is gradually away from the coil 45, the amplitudes of the signals S1*y* and SLy are extended and the frequency of the signal Dfy is also returned to that at the time point t1. After the metal body 41 was perfectly away from the coil 45 at a time point t8, the states of the signals s1*y*, SLy′ and Dfy are returned to those at the time point t1.

As mentioned above, the changes in amplitudes and frequencies of the signals S1*x*′ SLx′ Dfx′ S1*y*′ SLy′ and Dfy indicate a feature of the metal body 41. By analyzing those signals, the embodiment can be applied to the coin detecting apparatus and other metal body discriminating apparatus.

Figure 13D:
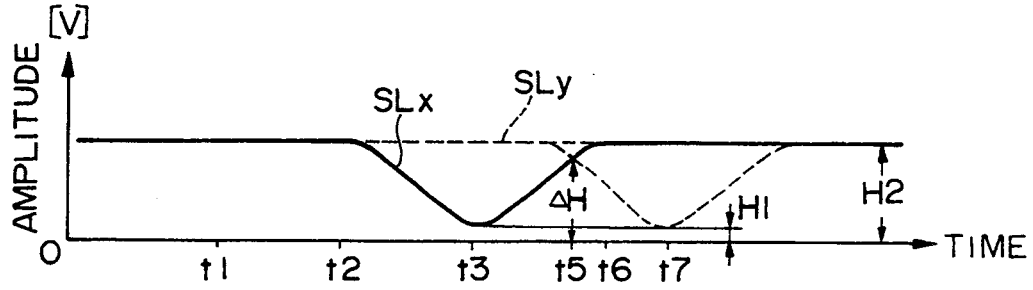
FIG. 13D is a waveform diagram showing signals SLx and SLy in correspondence to each timing in FIG. 13A.

Particularly, there are characteristics such that the amplitudes of the signals S1*x* and SLx decrease as the cross sectional area AR of the metal body 41 is large and that the frequencies of the signals Dfx and Dfy rise as the permeability of the metal body 41 is large. Therefore, as shown in FIG. 13D, a difference between the minimum amplitude H1 and the maximum amplitude H2 of the signal SLx or SLy is proportional to the cross sectional area of the metal body 41 at a high accuracy. The selection and discrimination of the metal body 41 can be realized from a viewpoint of the shape.

Further, as shown at a time point t5 in FIGS. 13A and 13D, when both edges of the metal body 41 equally overlap between the coils 50 and 45, the signals SLx and SLy cross, so that the diameter of the metal body 41 can be accurately detected from the amplitude ΔH at such a crossing time point.

Figure 13E:
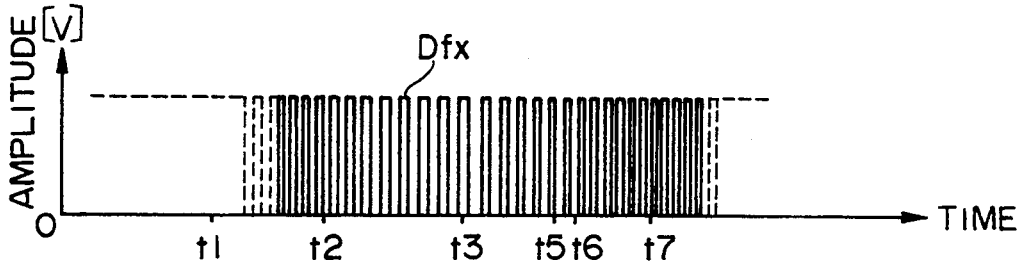
FIG. 13E is a waveform diagram showing a signal Dfx in correspondence to each timing in FIG. 13A.
Figure 13F:
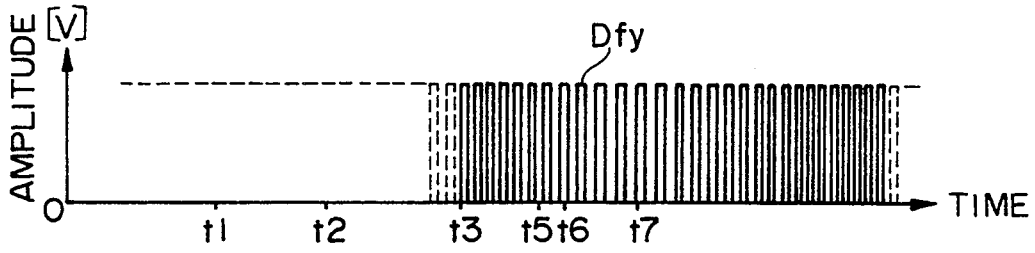
FIG. 13F is a waveform diagram showing a signal Dfy in correspondence to each timing in FIG. 13A.

As shown in FIG. 13E or 13F, by detecting the frequency of the signal Dfx or Dfy at a time point when the amplitude of the signal SLx or SLy has become minimum, the permeability of the metal body 41 can be known. By examining the frequency,m the metal body 41 can be selected and discriminated from a viewpoint of the material. By compoundly processing the above detection data, the discriminating process of a further high accuracy can be realized.

According to the second embodiment, in addition to the effects obtained by the first embodiment shown in FIGS. 1 to 8, further, the arrangement interval W2 between the pair of coils is set to a value which is equal to the minimum diameter among the diameters of a plurality of kinds of metal bodies to be discriminated and the amplitude ΔH when the detection signals SLx and SLy from the detecting circuits connected to those coils cross is detected, so that the diameter of the metal body can be detected at a high accuracy. By applying the embodiment to the coin detecting apparatus to select and discriminate many kinds of coins,the coin detecting apparatus of an extremely high accuracy can be realized.

In the first and second embodiments, the cores 53, 54, 55, and 56 have been provided as shown in FIG. 9. Those cores, however, have been provided so that the metal body is not influenced by the external magnetic field and the magnetic lines of force between the coils 45 and 50. If the cores are used in an apparatus which is not influenced by the magnetic field from the outside and the magnetic lines of force between the coils 45 and 50, those cores can be also omitted.

Although the above embodiments have been described with respect to the case where the discriminating sensor has been constructed by the pair of coils 45 and 50, the number of cores is not limited to two cores. A plurality of coils are arranged at predetermined intervals in consideration of the positional relation with the size of metal body and changes in detection signals are compoundly processed when the metal body passes in the respective coils, thereby enabling a complicated discriminating sensor of a high accuracy to be realized.

The technique of the invention, accordingly, incorporates all of the cases where two or more coils are used.

According to the metal body discriminating apparatuses of the invention as mentioned above, magnetic lines of force are generated by applying an AC current to the coil wound like a ring, the metal body is relatively moved in the hollow space of the coil, thereby changing the impedance and inductance of the coil by the operation of the eddy current which is generated in the metal body by the magnetic lines of force and detecting a change in AC signal corresponding to the changes in impedance and inductance as a feature parameter of the metal body. Therefore, the invention can be applied to metal body discriminating apparatuses in an extremely wide range because the structure is fairly simple and cheap, there is no mechanical adjustment portion, the apparatus is not also influenced by an environmental difference or the like, and a maintenance free structure is realized.

Further, according to the invention, since the high measuring accuracy can be maintained by using the region of the extremely uniform and stable magnetic flux density of the coil central portion, it is possible to realize a metal body discriminating apparatus in which a degree of freedom regarding the attaching direction and the moving velocity of the metal body is high and the apparatus can be properly attached at various angles to the vertical surface, horizontal surface, oblique surface, and the like.

By arranging two or more coils and setting the interval between the adjacent coils to a predetermined value for a size such as a diameter or the like of the metal body as an object to be measured and executing the measurement, changes in impedance and inductance of each of the coils when the metal body passes in the coils with a time deviation are generated as phase deviations in the detection signals. The size such as a diameter or the like of the metal body can be discriminated at a high accuracy from a change in frequency or amplitude of the detection signal having a phase deviation.

Although the embodiments have been described above with respect to the case of detecting coins which are used in Japan, the invention is not limited to those coins but can be also applied to detect coins which are used in other countries. Even in the case where different kinds of coins of a plurality of countries mixedly exist, the coins can be also detected at high accuracy.

The third embodiment of the present invention will be described next with reference to FIGS. 15 to 22D. Note that the third embodiment is based on an invention obtaining by further improving the second embodiment. More specifically, in the second embodiment, as shown in FIG. 9, the plurality of annular coils are separately formed. Furthermore, as shown in FIGS. 12A and 12B, the self-oscillators and the detecting circuits are arranged in units of coils. With such separate annular coils, self-oscillators, and the like, the frequency and amplitude characteristics of the respective oscillation signals independently vary owing to external environments at a place where the coin detecting apparatus is installed, changes in components (electronic components) with time, and the like. As a result, the characteristics of the apparatus may differ from those initially set. If the frequencies and amplitudes of the respective oscillation signals change together in a predetermined direction, the feature extraction precision can be kept relatively constant. In practice, however, such a state cannot be guaranteed, and the frequencies and amplitudes of the respective oscillation signal vary at random. Therefore, the feature extraction precision decreases, decreasing the denomination discrimination precision.

In order to solve such a problem, specific changes required to extract the frequency and amplitude features of the respective oscillation signals may be measured, and the average value of the respective measurement results may be obtained by a statistical method, thereby performing feature extraction on the basis of this average value. However, the use of such a technique leads to complicated signal processing and a decrease in speed of coin detection processing. Furthermore, since statistical processing is performed, feature extraction cannot always be performed with high precision.

It is, therefore, an object of the third embodiment to provide a coin detecting apparatus which can always perform feature extraction and coin discrimination with a predetermined precision regardless of such changes in external environment or changes in internal factor.

The structure of a sensor portion will be described below with reference to FIG. 15. A through hole 63 is formed in a hollow body 61 to allow the passage of a coin 62 to be detected. In addition, flange portions 64 and 65, and flange portions 66 and 67 are formed around the outer wall of the hollow body 61. The flange portions 64 and 65 oppose each other at a predetermined distance W1. The flange portions 66 and 67 oppose each other at a predetermined distance W2 (=W1). The flanges 65 and 66 are spaced apart from each other by a distance W3. The hollow body 61 and the flange portions 64, 65, 66, and 67 are integrally formed by using a plastic material or the like.

A relatively thin copper wire 68 with an insulating coating is wound around the outer wall of the hollow body 61 at positions between the flange portions 64 and 65, and between the flange portions 66 and 67, respectively, by a predetermined number T of turns, thereby forming a coil having first and second winding portions 69 and 70. Two ends 71 and 72 of the copper wire 68 extend outward.

A U-shaped core 73 consisting of a ferrite material or the like is forcibly fitted on the flange portions 64 and 65 from one direction so as to clamp them. A core 74 having the same shape and consisting the same material as those of the core 73 is forcibly fitted on the flange portions 66 and 67 from the same direction so as to clamp them. Although an exploded view is shown in FIG. 15, cores 75 and 76 have the same shape and consist of the same material as those of the cores 73 and 74, and are forcibly fitted on the flange portions 64 and 65, and 66 and 67, respectively, so as to oppose the cores 73 and 74.

In this case, the distance W3 is set to be almost equal to the diameter of a coin having the minimum diameter. For example, in a coin detecting apparatus used in Japan, the distance W3 is set to be slightly smaller than the diameter of a 1-yen coin, which is smaller than any other coins, i.e., a 5-yen coin, a 10-yen coin, a 50-yen coin, a 100-yen coin, and a 500-yen coin.

Figure 15:
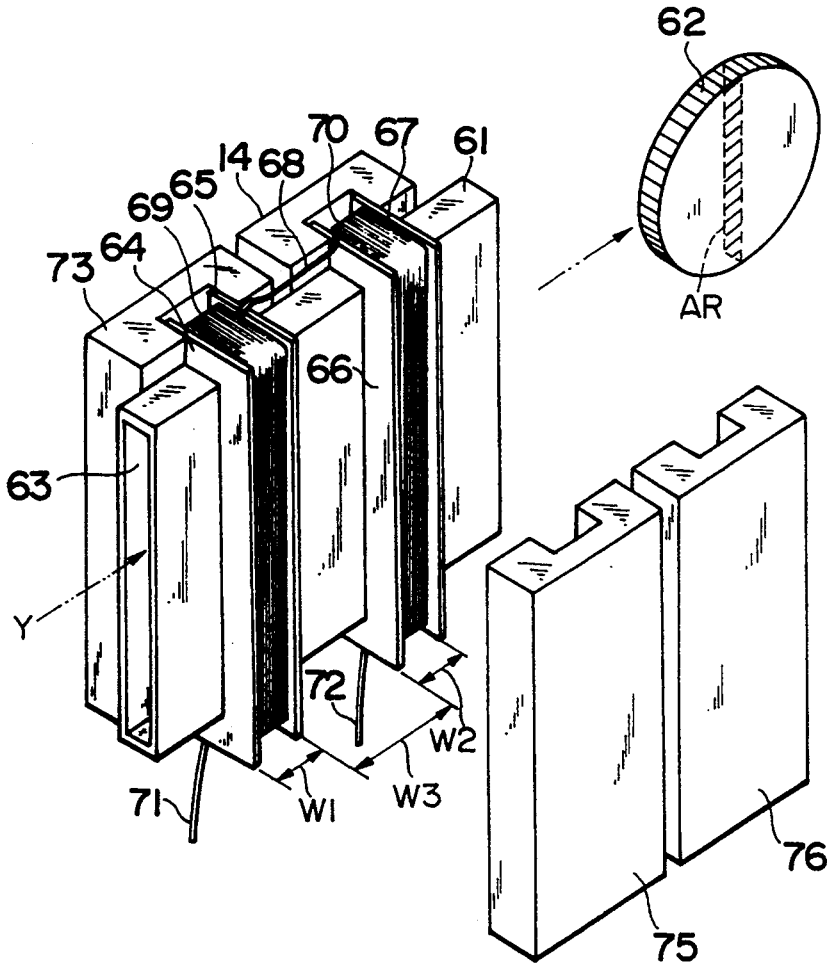
FIG. 15 is a perspective view showing the structure of a metal body sensor used for a metal body discriminating apparatus according to a third embodiment according to the present invention.
Figure 16:
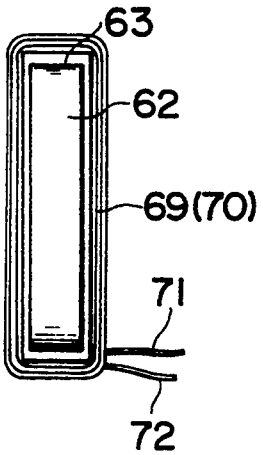
FIG. 16 is a view showing the positional relationship between a metal body and the coils of a metal body discriminating sensor according to the third embodiment.
Figure 17:
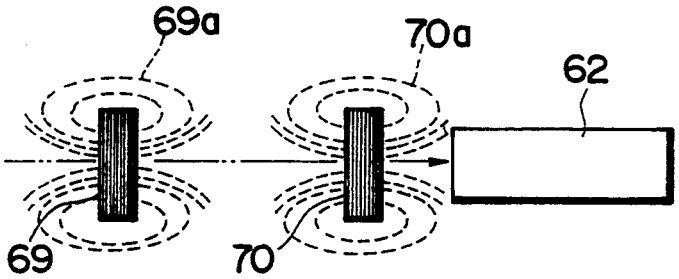
FIG. 17 is a view showing the measurement principle of the metal body discriminating apparatus according to the third embodiment.

The shape of the through hole 63 is designed to be similar to and slightly larger than the cross-section of the largest coin, taken along the radial direction, (e.g., indicated by a hatched portion AR in FIG. 15). As shown in FIG. 16, therefore, a coin can pass through the through hole 63 with a slight gap. This through hole 63 is simply formed as a guide hole for allowing a coin to pass through the winding portions 69 and 70, but is not designed to define the passage position of a coin with respect to the winding portions 69 and 70, with a high mechanical precision.

Self-oscillators are respectively connected to the two ends 71 and 72 of the coil. These self-oscillators self-oscillate in cooperation with the coil. With this structure, as indicated by the measurement principle in FIG. 17, the winding portions 69 and 70 are respectively caused to generate lines of magnetic force **69*a* and 70*a* having a predetermined magnetic flux density in advance, so that when the coin 62 passes through the through hole 63, it receives the effects of the lines of magnetic force 69***a* and 70*a*.

Figure 18:
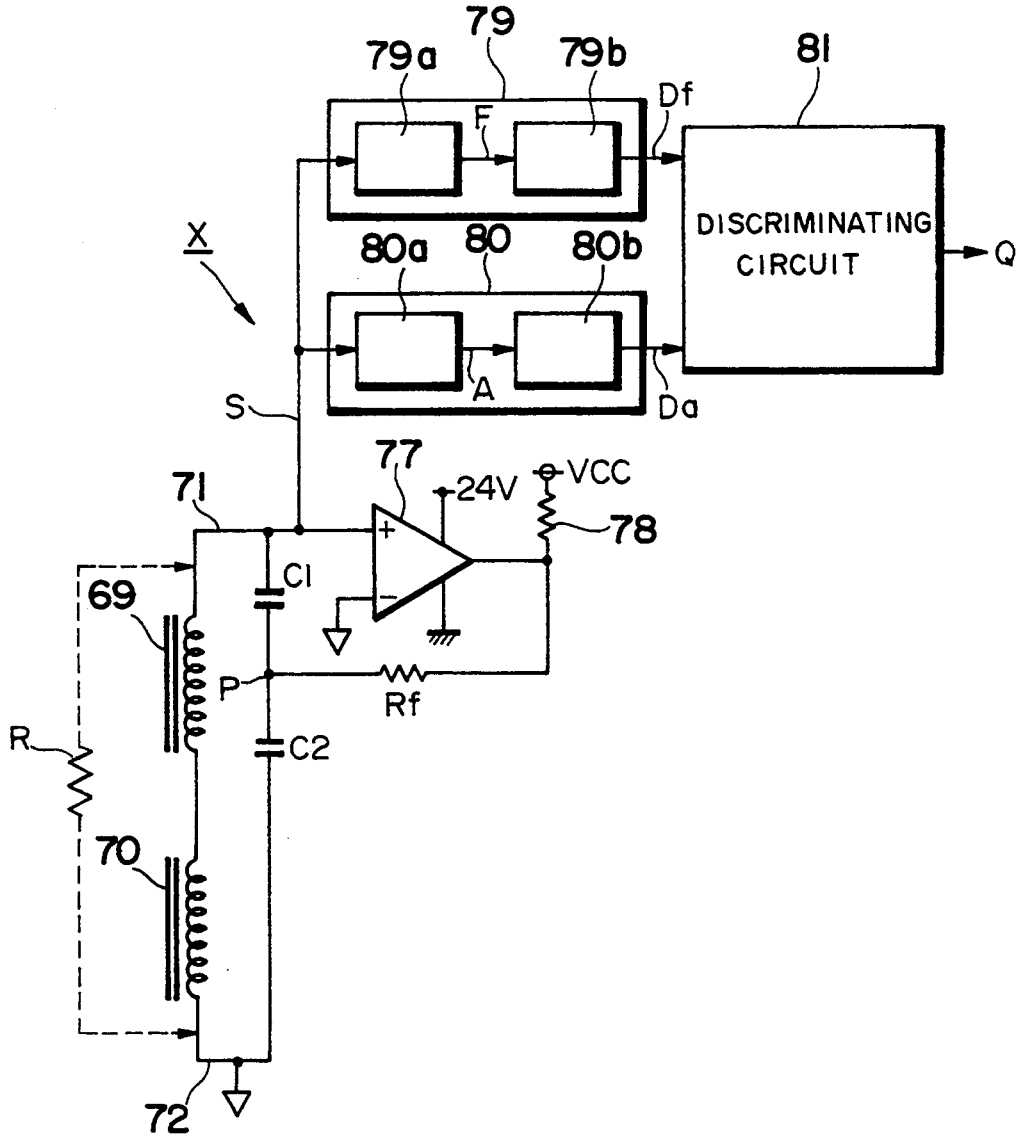
FIG. 18 is a circuit diagram showing detecting circuits applied to the metal body discriminating apparatus according to the third embodiment.

A detecting circuit X added to the coil will be described below with reference to FIG. 18. Capacitors C1 and C2 are connected in series between the two ends 71 and 72 of the coil. In addition, the end 71 is connected to the non-inverting input contact of a comparator 77, and the end 72 and the inverting input contact of the comparator 77 are connected to the earth contact. Note that the two ends 71 and 72 of the coil may be connected inversely.

The comparator 77 is operated by a power source of a predetermined voltage. The output contact of the comparator 77 is biased to a predetermined voltage Vcc through a resistor 78 and is connected to a common node P of the capacitors C1 and C2 through a feedback resistor Rf. Note that the inductance and impedance of the winding portions 69 and 70 change under the influence of an eddy current generated when the coin 62 passes through the winding portions 69 and 70. Referring to FIG. 18, this change in impedance is equivalently indicated by reference symbol R. In addition, the inductance (L) of the winding portions 69 and 70 theoretically changes in accordance with the following equation:

$$L=K\cdot\mu\cdot M^2\cdot S\cdot l\cdot 10^{-7}(\mathrm{H})$$

where K is the Nagaoka coefficient, L is the inductance, $\mu$ is the permeability of a coin, M is the number of turns of the coil, S is the cross sectional area of the coil, and l is the length of the coil (corresponding to widths W1 and W2 in FIG. 1).

The comparator 77, the capacitors C1 and C2, the feedback resistor Rf, the resistor 78, and the winding portions 69 and 70 constitute a Colpitts self-oscillator. An oscillation signal S whose frequency and amplitude are determined by the circuit constant of the tuning circuit constituted by the capacitors C1 and C2 and the winding portions 69 and 70 is generated at the end 71. When the coin 62 passes through a magnetic field generated by the winding portions 69 and 70, the amplitude and frequency of the oscillation signal S change with changes in inductance and impedance. As a result, the following characteristics are obtained. The amplitude of the oscillation signal S changes in accordance with changes in the cross sectional area AR and diameter of the coin 62 (see FIGS. 19 and 20). The frequency of the oscillation signal S changes in accordance with changes in the permeability of the coin 62 (see FIG. 21).

A frequency detecting circuit 79 comprises a wave-shaping circuit 79*a* for wave-shaping the oscillation signal S into a binary rectangular signal F without changing its frequency, and a measuring circuit 79*b* for detecting the frequency of the oscillation signal S by measuring the generation frequency of the rectangular signal F represented by logic "1" and logic "0", and outputting the detection result as digital frequency data Df at a predetermined period $\tau$. An envelope detecting circuit 80 comprises an envelope detector 80*a* for detecting the envelope of the positive amplitude voltage of the oscillation signal S, and an A/D converter 80*b* for converting a resulting analog envelope signal A into a digital signal, and outputting it as digital amplitude data Da at the predetermined period $\tau$. The frequency data Df and the amplitude data Da are input to a denomination discriminating circuit 81, thus performing denomination discrimination. For example, the sensor portion shown in FIG. 15 is mounted at the coin insertion port of the coin detecting apparatus directly or through a convey mechanism such that the coin 62 passes through the through hole 63 upon falling.

Figure 22A:
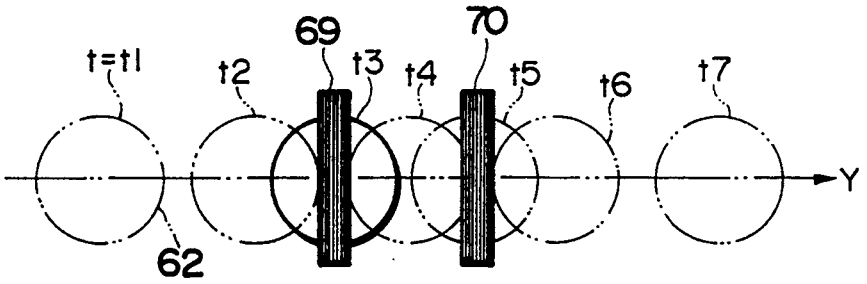
FIG. 22A is a view for explaining an operation of the metal body discriminating apparatus according to the third embodiment.
Figure 22B:
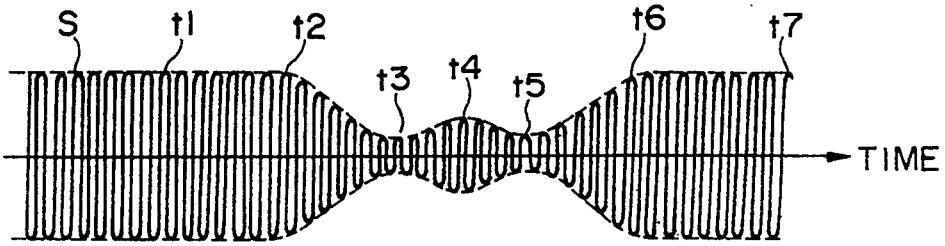
FIG. 22B is a timing chart showing the waveform of a signal S in correspondence with each timing in FIG. 22A.
Figure 22C:
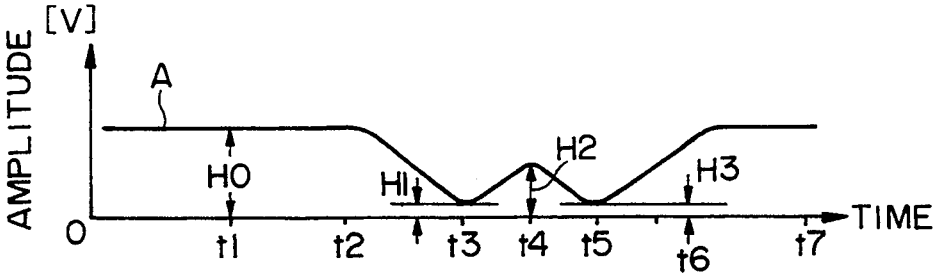
FIG. 22C is a timing chart showing the waveform of a signal A in correspondence with each timing in FIG. 22A.

An operation of the detecting circuit X will be described next with reference to FIGS. 22A to 22D. Assume that the coin 62 passes through the hollow portions of the winding portions 69 and 70 and moves along the through hole 63 in the direction indicated by an arrow Y, as shown in FIG. 15. Note that the relationships between the envelope signal A and the amplitude data Da and between the generation frequency of the rectangular signal F and the frequency data Df are no more than the relationships between analog signals and digital data, and are substantially the same. Therefore, for the sake of descriptive convenience, the following description will be based on the analog envelope signal A and the rectangular signal F. Furthermore, note that FIG. 22A shows the positional relationship between the coin 62 and the winding portions 69 and 70; FIG. 22B, the oscillation signal S; FIG. 22C, the waveform of the envelope signal A; and FIG. 22D, the rectangular signal F.

Referring to FIGS. 22A to 22D, when the coin 62 is inserted in neither of the winding portions 69 and 70, as before a given time point t1, the oscillation signal S having a predetermined frequency and a predetermined amplitude, uniquely determined by the inductance of the winding portions 69 and 70 in a state wherein the coin 62 is not influenced by a magnetic field, is generated (see FIG. 22B). Accordingly, the envelope signal A detected by the envelope detecting circuit 80 has a constant amplitude H0 (see FIG. 22C), and the generation frequency of the rectangular signal F detected by the frequency detecting circuit 79 becomes constant (see FIG. 22D).

Figure 22D:
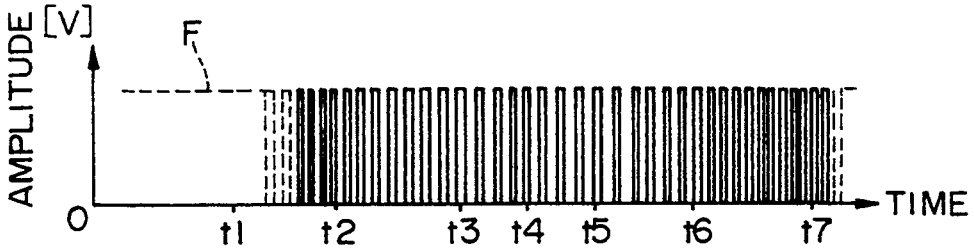
FIG. 22D is a timing chart showing the waveform of a signal F in correspondence with each timing in FIG. 22A.

When the leading end portion of the coin 62 enters the hollow portion of the first winding portion 69, as at a given time point t2, an eddy current is generated at the leading end portion due to the influence of a magnetic field, and the inductance and impedance R of the winding portions 69 and 70 change, so that the frequency and amplitude of the oscillation signal S start to change. At the same time, the amplitude of the envelope signal A decreases, and the generation frequency of the rectangular signal F starts to change. If the coin 62 consists of a material having a permeability higher than that of air, the frequency of the oscillation signal S decreases with an increase in the area of the overlapping portion between the coin 62 and the winding portions 69 and 70, as shown in FIG. 22D. In contrast to this, if the coin 62 consists of a material having a permeability lower than that of air, the frequency of the oscillation signal S increases with an increase in the area of the overlapping portion between the coin 62 and the winding portions 69 and 70.

In this case, the coin 62 consisting of a material having a permeability higher than that of air passes through the winding portions 69 and 70.

As the coin 62 proceeds in the hollow portion of the winding portion 69, the eddy current gradually increases. With this change in eddy current, the frequency and amplitude of the oscillation signal S, the amplitude of the envelope signal A, and the generation frequency of the rectangular signal F change.

When a central portion of the coin 62 coincides with a central portion of the winding portion 69, as at a time point t3, the current generated in the coin 62 is maximized, and the amplitudes of the oscillation signal S and the envelope signal A become a minimum value H1, as shown in FIGS. 22B and 22C. At the same time, the generation frequency of the rectangular signal F decreases.

As the coin 62 gradually moves away from the winding portion 69, as in the time interval between the time point t3 and a time point t4, the frequencies of the oscillation signal S and the rectangular signal F increase to the original frequencies. Similarly, the amplitudes of the oscillation signal S and the envelope signal A increase to the original amplitudes.

When the area of the overlapping portion between the leading end portion of the coin 62 and the winding portion 70 becomes equal to that of the overlapping portion between the trailing end portion of the coin 62 and the winding portion 69, as at the time point t4, the amplitudes of the oscillation signal S and the envelope signal A become an amplitude H2 corresponding to the overlapping portions. At the same time, the frequencies of the oscillation signal S and the rectangular signal F become a frequency corresponding to the overlapping portions.

As the trailing end portion of the coin 62 moves away from the first winding portion 69 and gradually enters the second winding portion 70, as in the time interval between the time point t4 and a time point t5, the eddy current generated in the coin 62 increases owing to the influence of a magnetic field generated by the second winding portion 70. With this increase in eddy current, the amplitudes of the oscillation signal S and the envelope signal A gradually decrease. Similarly, the frequencies of the oscillation signal S and the rectangular signal F gradually decrease.

After the time point t5, as the coin 62 gradually moves away from the winding portion 70, the amplitudes of the signals S and A increase. At the same time, the frequency of the rectangular signal F is gradually restored to the frequency at the time point t1. After the coin 62 is completely separated from the winding portion 70 at a time point t7, the signals S, A, and F are restored to the state at the time point t1.

In this case, these changes in the amplitudes and frequencies of the signals S, A, and F indicate the characteristics of the coin 62 of each denomination. Especially, as the cross sectional area AR of the coin 62 increases, the minimum amplitudes H1 and H3 of the signals S and A decrease. In addition, as the permeability of the coin 62 increases, the generation frequency of the rectangular signal F, obtained when the signals S and A have the minimum amplitudes H1 and H3, decreases.

The present inventor has learnt by experiment that there are correlations between the minimum amplitudes H1 and H3 and the cross sectional area AR of the coin 62, between the amplitude H2 of the signal A, obtained when the signal has a mountain-like shape, and the diameter of the coin 62, as indicated at the time point t4 in FIG. 22C, and between the generation frequency, obtained when the signal A has the minimum amplitudes H1 and H3, and the material (permeability) for the coin 62. By using such correlations as feature data of the coin 62, denomination discrimination is automatically performed by the denomination discriminating circuit 81 (to be described later).

The denomination discriminating circuit 81 is realized by a microcomputer system having an arithmetic function. The denomination discriminating circuit 81 is designed to receive the amplitude data Da and the frequency data Df at the predetermined period $\tau$, and sequentially compare the magnitudes of the amplitudes before and after the amplitude data Da input at the period $\tau$, thereby detecting the minimum amplitudes H1 and H3, and the amplitude H2, obtained when the signal A has a mountain-like shape, as shown in FIG. 22C.

The denomination discriminating circuit 81 then compares the detected amplitudes with reference data of the minimum amplitudes H1 and H3, and the amplitude H2 obtained when the signal A has a mountain-like shape, which data are associated with each denomination and stored as a look-up table in advance, thereby outputting a discrimination result Q for the coin 62 which is most consistent with the detected amplitudes.

As described above, according to the third embodiment, the coin detecting apparatus has the self-oscillator which oscillates in cooperation with one coil having two winding portions 69 and 70, and specific feature data represented by changes in the frequency and amplitude of the oscillation signal S, appearing when the coin 62 passes through the winding portions 69 and 70, are extracted as feature data. That is, feature extraction can be performed on the basis of one oscillation signal S. Therefore, in the third embodiment, the processing speed is increased, and the processing circuit can be simplified as compared with the second embodiment in which the sensor portion is constituted by the separate self-oscillators which operate in cooperation with a plurality of coils, and feature extraction is performed by performing signal processing of a plurality of oscillation signals output from the respective self-oscillators. In addition, since separate self-oscillators are not used, the apparatus is free from a decrease in coin detection precision due to random changes in the characteristics of the respective self-oscillators. Therefore, the coin detection precision can be increased.

The fourth embodiment of the present invention will be described in detail below with reference to FIGS. 23 to 29. This embodiment is designed to provide a means for increasing the detection precision of the metal body discriminating apparatuses disclosed by the first to third embodiments.

More specifically, the first to third embodiments disclose new metal body discriminating apparatuses which have not existed in the past. Furthermore, the third embodiment discloses an arrangement which can eliminate variations in the characteristics of the respective components. Although the first to third embodiments have basically excellent functions, they are still not completely free from the problem of a decrease in coin detection precision due to environmental changes at places where the apparatuses are installed, and changes in the characteristics of the components of the apparatuses. Note that the third embodiment can suppress a decrease in detection precision due to variations in the characteristics of the respective components, but is still subjected to changes in the overall characteristics of the apparatus due to environmental changes. In this regard, there is room for further improvement in the coin detection precision.

The problems of these embodiments will be described in detail below. A coin detecting apparatus is not always installed in an environment kept in a constant state but is often installed at a place where great environmental changes such as temperature and humidity changes occur. For example, a coin detecting apparatus is incorporated in an automatic railway ticket vending machine or an automatic beverage vending machine and is installed outdoors. With such environmental changes, the characteristics of the components (electronic components and the like) of the coin detecting apparatus vary, resulting in variations in coin detection precision. In addition, the coin detection precision decreases as each component undergoes a change over time. It is very cumbersome for a maintenance man to readjust the apparatus every time the coin detection precision varies, resulting in a deterioration in reliability. It is an object of the fourth embodiment to provide a coin detecting apparatus having an automatic compensating function of automatically maintaining a given coin detection precision even if such environmental changes or changes in internal factor occur.

In the fourth embodiment, a coin detecting apparatus obtained by applying the detecting circuit in the third embodiment (see FIG. 18) to the sensor portion having the two independent coils and self-oscillators described in the second embodiment (see FIGS. 9 to 12B) incorporates a means for increasing the detection precision.

Figure 23:
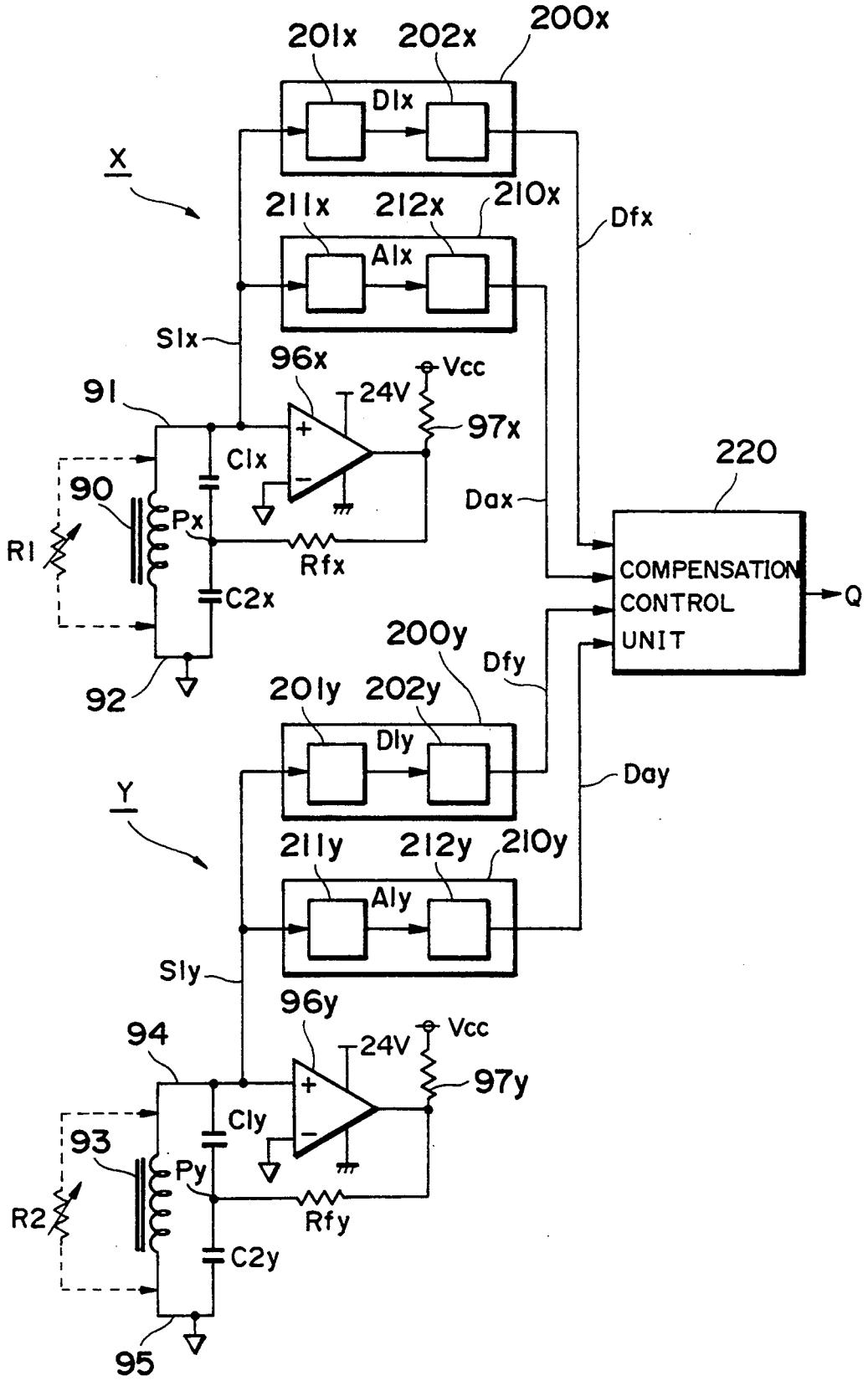
FIG. 23 is a circuit diagram showing the circuit arrangement of the fourth embodiment according to the present invention.

FIG. 23 shows the overall circuit arrangement. A detecting circuit X is connected to two ends 91 and 92 of a first coil 90 (corresponding to the coil 50 in the second embodiment), and a detecting circuit Y is connected to two ends 94 and 95 of a second coil 93 (corresponding to the coil 45 in the second embodiment). The coils 90 and 93 have the same characteristics, and the detecting circuits X and Y have the same circuit arrangement.

The detecting circuits X and Y will be described first. Capacitors C1*x* and C2*x* are connected in series between the two ends 91 and 92 of the coil. In addition, the end 91 is connected to the non-inverting input contact of a comparator 96*x*, and the end 92 and the inverting input contact of the comparator 96*x* are connected to the earth contact. The comparator 96*x* is operated by a power source of a predetermined voltage. The output contact of the comparator 96*x* is biased to a predetermined voltage Vcc through a resistor 97*x* and is connected to a common node Px of the capacitors C1*x* and C2*x* through a feedback resistor Rfx. Note that the inductance and impedance of the coil 90 change under the influence of an eddy current generated when a coin passes through the coil 90. Referring to FIG. 23, this change in impedance is equivalently indicated by reference symbol R1. In addition, the inductance (L) of the coil 90 theoretically changes in accordance with the following equation:

$$L=K\cdot\mu\cdot M^2\cdot S\cdot l\cdot 10^{-7}(H)$$

where K is the Nagaoka coefficient, L is the inductance, $\mu$ is the permeability of a coin, M is the number of turns of the coil, S is the cross sectional area of the coil, and l is the length of the coil (corresponding to widths W1 and W2 in FIG. 9).

Figure 19:
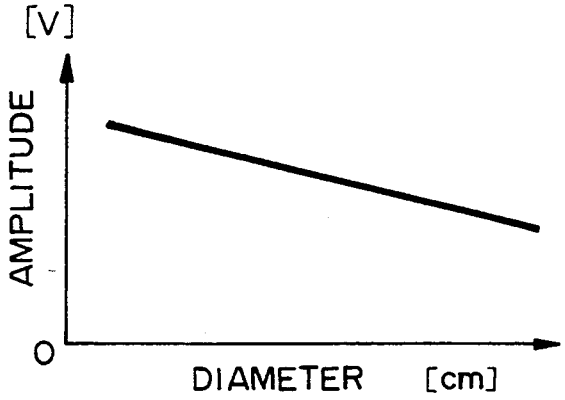
FIG. 19 is a graph showing a characteristic of a detection signal obtained by the metal body discriminating apparatus according to the third embodiment.
Figure 20:
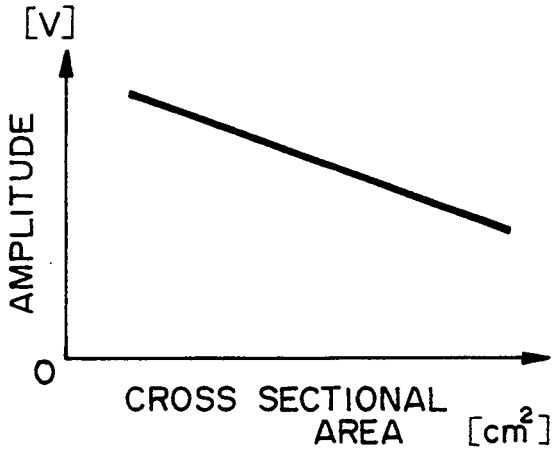
FIG. 20 is a graph showing another characteristic of the detection signal obtained by the metal body discriminating apparatus according to the third embodiment.
Figure 21:
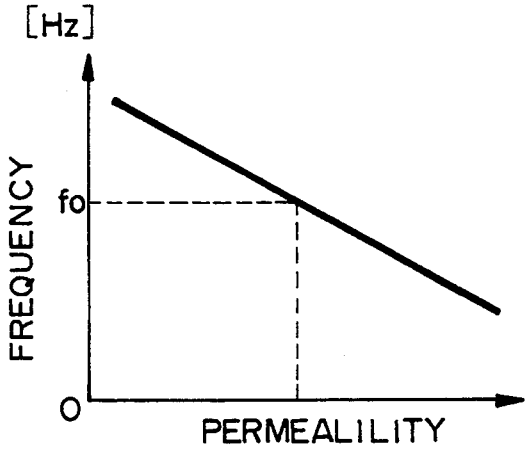
FIG. 21 is a graph showing still another characteristic of the detection signal obtained by the metal body discriminating apparatus according to the third embodiment.

The comparator 96*x*, the capacitors C1*x* and C2*x*, the feedback resistor Rfx, the resistor 97*x*, and the coil 90 constitute a Colpitts self-oscillator. An oscillation signal S1*x* whose frequency and amplitude are determined by the circuit constant of the tuning circuit constituted by the capacitors C1*x* and C2*x* and the coil 90 is generated at the end 91. When a coin passes through a magnetic field generated by the coil 90, the amplitude and frequency of the oscillation signal S1*x* change with changes in inductance and impedance. As a result, as shown in FIGS. 19 to 21, the following characteristics are obtained. The amplitude of the oscillation signal S1*x* changes in accordance with changes in the cross sectional area Ar and diameter of the coin. The frequency of the oscillation signal S1*x* changes in accordance with changes in the permeability of the coin.

A frequency detecting circuit 200*x* comprises a wave-shaping circuit 201*x* for wave-shaping the oscillation signal S1*x* into a binary rectangular signal D1*x* without changing its frequency, and a measuring circuit 202*x* for detecting the frequency of the oscillation signal S1*x* by measuring the generation frequency of the rectangular signal D1*x* represented by logic "1" and logic "0", and outputting the detection result as digital frequency data Dfx at a predetermined period $\tau$. A detecting circuit 210*x* comprises an envelope detector 211*x* for detecting the envelope of the positive amplitude voltage of the oscillation signal S1*x*, and an A/D converter 212*x* for converting a resulting analog envelope signal A1*x* into a digital signal, and outputting it as digital amplitude data Dax at the predetermined period $\tau$. The detecting circuit Y has the same circuit arrangement as that of the detecting circuit X. That is, a reference numeral, obtained by replacing "x" as a suffix of each reference numeral denoting a corresponding component of the detecting circuit X with "y", denotes the same component as that of the detecting circuit Y.

The frequency data Dfx and Dfy and the amplitude data Dax and Day output from the detecting circuits X and Y are input to a compensation control unit 220, and the denomination of the coin is discriminated by compensation and coin detection processing (to be described later). The compensation control unit 220 then outputs a discrimination result Q. Note that the sensor portion is mounted, for example, at the coin insertion port of the coin detecting apparatus directly or through a convey mechanism such that a coin to be detected passes through the hollow portions of the coils 90 and 93 upon falling.

Figure 24A:
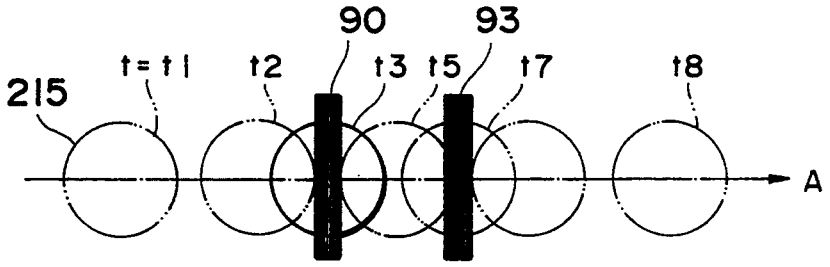
FIG. 24A is a view for explaining an operation of the fourth embodiment.

Operations of the detecting circuits X and Y will be described next with reference to FIGS. 24A to 24F. Assume that a coin 215 to be detected passes through the hollow portions of the coils 90 and 93 and moves in the direction indicated by an arrow A, as shown in FIG. 24A. Note that the relationships between the envelope signal A1*x* and the amplitude data Dax, between the generation frequency of an envelope signal Ay1 and amplitude data Day, between the generation frequency of the rectangular signal D1*x* and the frequency data Dfx, and between the generation frequency of the rectangular signal D1*y* and the frequency data Dfy are no more than the relationships between analog signals and digital data, and are substantially the same. Therefore, for the sake of descriptive convenience, the following description will be based on the analog envelope signals A1*x* and A1*y* and the rectangular signals D1*x* and D1*y*.

Figure 24B:
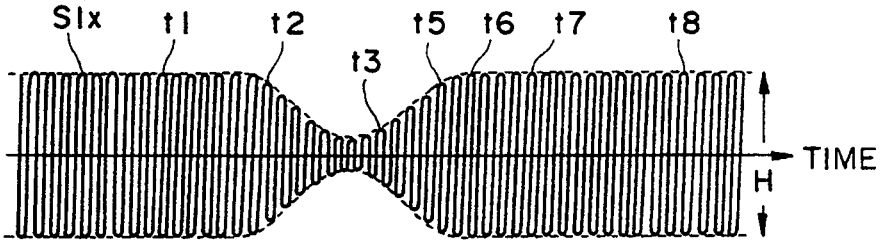
FIG. 24B is a timing chart showing the waveform of a signal S1*x* in correspondence with each timing in FIG. 24A.
Figure 24C:
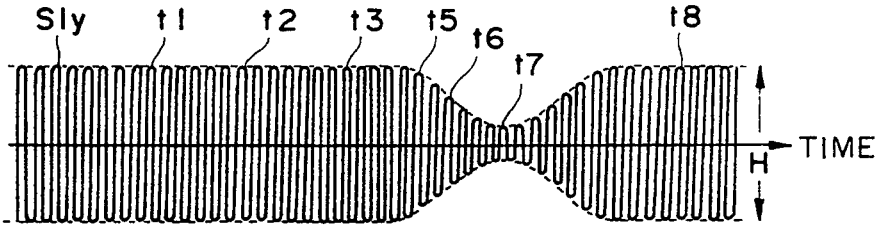
FIG. 24C is a timing chart showing the waveform of a signal S1*y* in correspondence with each timing in FIG. 24A.

Referring to FIGS. 24A to 24F, when the coin 215 is inserted in neither of the coils 90 and 93, as before a given time point t1, the oscillation signals S1*x* and S1*y* having predetermined frequencies and predetermined amplitudes, uniquely determined by the inductances of the coils 90 and 93 in a state wherein the coin 215 is not influenced by any of lines of magnetic force, are generated (see FIGS. 24B and 24C). Thus, the envelope signals A1*x* and A1*y* detected by the detecting circuits 210*x* and 210*y* have a constant amplitude H0 (see FIG. 24D), and the generation frequencies of the rectangular signals D1*x* and D1*y* detected by the frequency detecting circuits 200$x$ and 200$y$ become constant (see FIGS. 24E and 24F).

When the leading end portion of the coin 215 enters the hollow portion of the first coil 90, as at a given time point t2, an eddy current is generated at the leading end portion due to the influence of lines of magnetic force, and the inductance and impedance R1 of the coil 90 change, so that the frequency and amplitude of the AC signal S1$x$ start to change. At the same time, the amplitude of the envelope signal A1$x$ decreases, and the generation frequency of the rectangular signal D1$x$ starts to change. If the coin 215 consists of a material having a permeability higher than that of air, the frequency of the oscillation signal S1$x$ decreases with an increase in the area of the overlapping portion between the coin 215 and the coil 90. In contrast to this, if the coin 215 consists of a material having a permeability lower than that of air, the frequency of the oscillation signal S1$x$ increases with an increase in the area of the overlapping portion between the coin 215 and the coil 90. In this case, the coin 215 consisting of a material having a permeability higher than that of air passes through the coil 90.

As the coin 215 proceeds in the hollow portion of the coil 90, the eddy current gradually increases. With this change in eddy current, the frequency and amplitude of the AC signal S1$x$, the amplitude of the envelope signal A1$x$, and the generation frequency of the rectangular signal D1$x$ change.

When a central portion of the coin 215 coincides with a central portion of the coil 90, as at a time point t3, the current generated in the coin 215 is maximized, and the amplitudes of the AC signal S1$x$ and the envelope signal A1$x$ become a minimum value H1. At the same time, the generation frequency of the rectangular signal D1$x$ is minimized.

As the coin 215 gradually moves away from the winding portion 69, as after the time point t3, the amplitudes and generation frequencies of the signals S1$x$, A1$x$, and D1$x$ are restored to the values at the time point t1.

As the coin 215 moves, and the leading end portion of the coin 215 overlaps the second coil 93, the amplitudes and generation frequencies of the signals S1$y$, A1$y$, and D1$y$ detected by the second detecting circuit Y associated with the coil 93 start to change.

When the area of the overlapping portion between the leading end portion of the coin 215 and the coil 93 becomes equal to that of the overlapping portion between the trailing end portion of the coin 215 and the coil 90, as at a time point t5, the envelope amplitudes of the signals A1$x$ and A1$y$ become the same value H2.

After the coin 215 is completely separated from the coil 90, as at a time point t6, the signals S1$x$, A1$x$, and D1$x$ are restored to the state at the time point t1.

When the area of the overlapping portion between the coin 215 and the coil 93 is maximized as the coin 215 proceeds in the coil 93, as at a time point t7, the amplitude of the AC signal S1$y$ becomes the minimum value H1. At the same time, the amplitude of the envelope signal A1$x$ and the generation frequency of the rectangular signal D1$x$ are minimized.

After the time point t7, the amplitudes of the signals S1$y$ and A1$y$ increase to the values at the time point t1 as the coin 215 moves away from the coil 93. After the coin 215 is completely separated from the coil 93 at a time point t8, the signals S1$y$, A1$y$, and D1$y$ are restored to the state at the time point t1.

In this case, these changes in the amplitudes and generation frequencies of the signals A1$x$, D1$x$, A1$y$, and D1$y$ indicate the characteristics of the coin 215 of each denomination. Especially, as the cross sectional area AR of the coin 215 increases, the minimum amplitude H1 of the signals A1$x$ and A1$y$ decreases. In addition, as the permeability of the coin 215 increases, the generation frequencies of the rectangular D1$x$ and D1$y$, obtained when the signals A1$x$ and A1$y$ have the minimum amplitude H1, decrease.

The present inventor has learnt by experiment that there are correlations between the minimum amplitude H1 and the cross sectional area AR of the coin 215, between the amplitude (to be referred to as the cross amplitude hereinafter) H2 of the signal A, obtained when the envelope signals A1$x$ and A1$y$ cross each other, and the diameter of the coin 215, as indicated at the time point t5 in FIG. 24D, and between the generation frequency, obtained when the signals A1$x$ and A1$y$ have the minimum amplitude H1, and the material (permeability) for the coin 215. By using such correlation as feature data of the coin 215, denomination discrimination is automatically performed by the compensation control unit 220 (to be described later). Note that the compensation control unit 220 does not process the minimum amplitude H1 and the cross amplitude H2 with reference to the earth level but processes them with reference to the amplitude (maximum amplitude) H0, of the envelope signals A1$x$ and A1$y$, generated when the coin is not inserted in the coils 90 and 93, by using the difference (H0 −H1) between the amplitude H0 and the minimum value H1, as cross sectional area data $\beta$ representing the cross sectional area feature of the coin, and the difference (H0−H2) between the amplitude H0 and the cross amplitude H2, as shape data $\alpha$ representing the diameter feature of the coin.

The arrangement of the compensation control unit 220 will be described below with reference to FIG. 25. The compensation control unit 220 is realized by a microcomputer system having an arithmetic function. The compensation control unit 220 comprises an processing unit 230 for performing an arithmetic operation for extracting the features of a coin to be detected upon reception of the frequency data Dfx and Dfy and the amplitude data Dax and Day from the detecting circuit X and Y, a discriminator 240 for discriminating the denomination of the coin on the basis of the feature extraction result obtained by the processing unit 230, a read-only memory (ROM) 250 for storing standard discriminating coefficient data required for denomination discrimination, an electrically erasable and programmable ROM (EEPROM) 260 for holding gauge data required to create actually required discrimination reference data from the standard discriminating coefficient data, and a timing controller 270 for setting an operation timing.

The processing unit 230 receives the frequency data Dfx and Dfy and the amplitude Dax and Day from the detecting circuits X and Y at a predetermined period $\tau$ (e.g., 1 ms), and calculates the difference (Day−Dax) between the amplitude data Day and Dax. If the state wherein the difference (Day−Dax) is 0 continues before and after the period $\tau$, the processing unit 230 determines that a coin to be detected has not passed through the coils 90 and 93, and holds the amplitude data Dax at the latest timing as reference level data $\gamma$. That is, this operation corresponds to measurement of the maximum envelope amplitude H0 in FIG. 24D.

Figure 24D:
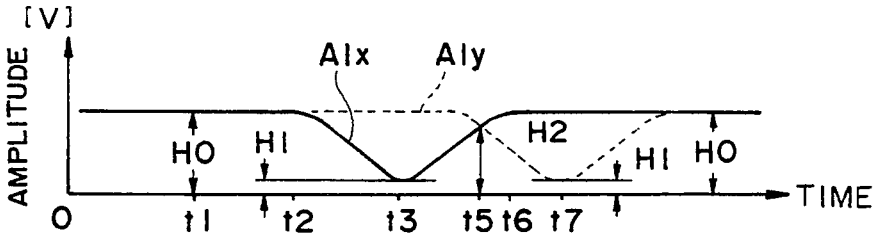
FIG. 24D is a timing chart showing the waveforms of signals A1*x* and A1*y* in correspondence with each timing in FIG. 24A.
Figure 24E:
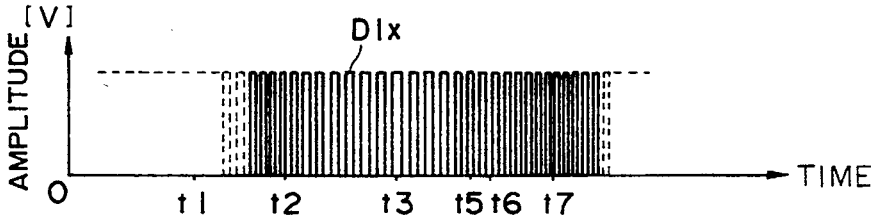
FIG. 24E is a timing chart showing the waveform of a signal D1*x* in correspondence with each timing in FIG. 24A.
Figure 24F:
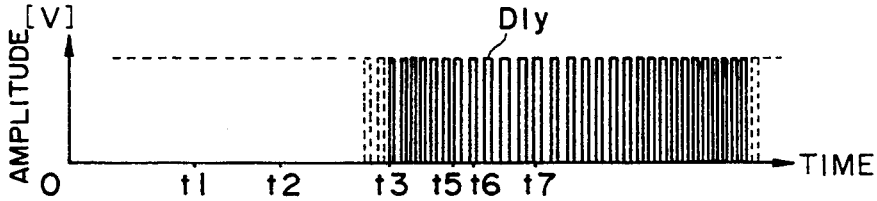
FIG. 24F is a timing chart showing the waveform of a signal D1*y* in correspondence with each timing in FIG. 24A.

If the difference (Day−Dax) becomes a value other than 0, the processing unit 230 determines that a coin to be detected is passing through the coils 90 and 93, and holds the amplitude data Dax obtained at a time point at which the difference (Day−Dax) is maximized (corresponding to the minimum amplitude H1 in FIG. 24D). At the same time, the processing unit 230 holds the frequency data Dfx, obtained at this time point, as frequency data 72 . In addition, upon obtaining the minimum amplitude H1, the processing unit 230 holds the amplitude data Dax obtained at a time point at which the difference (Day−Dax) becomes 0 again (corresponding to the cross amplitude H2 in FIG. 24D). Thereafter, the shape data $\alpha$ and the cross sectional area data $\gamma$ are obtained by arithmetic operations of $\alpha=H0-H2$ and $\beta=H0-H1$.

By repeating such processing, latest reference level data $\gamma$ is held when no coin to be detected passes through the sensor portion, and feature data constituted by the shape data $\alpha$, the cross sectional area data $\beta$, and the frequency data $\eta$ is generated when a coin to be detected passes through the sensor portion.

Standard discriminating coefficient data associated with the shape, cross sectional area, and frequency features of target denominations are stored in the ROM 250 in advance. Standard discriminating coefficient data are created by the following statistic method. When, for example, a plurality of denominations a, b, c, . . . are to be detected, N coins are prepared in units of denominations, and all the coins are caused to pass through a coin detecting apparatus exclusively designed for creating standard discriminating coefficient data, thus measuring the following data associated with the respective coins: shape data $\alpha_{a1}, \alpha_{a2}, \alpha_{a3}, \ldots, \alpha_{aN}, \alpha_{b1}, \alpha_{b2}, \alpha_{b3}, \ldots, \alpha_{bN}$, and $\alpha_{cN}, \alpha_{b1}, \alpha_{b2}, \alpha_{b3}, \ldots, \alpha_{bN}$; cross sectional area data $\beta_{a1}, \beta_{a2}, \beta_{a3}, \ldots, \beta_{aN}, \beta_{b1}, \beta_{b2}, \beta_{b3}, \ldots, \beta_{bN}$, and $\beta_{cN}, \beta_{b1}, \beta_{b2}, \beta_{b3}, \ldots, \beta_{bN}$; and frequency data $\eta_{a1}, \eta_{a2}, \eta_{a3}, \ldots, \eta_{aN}, \eta_{b1}, \eta_{b2}, \eta_{b3}, \ldots, \eta_{bN}$, and $\eta_{cN}, \eta_{b1}, \eta_{b2}, \eta_{b3}, \ldots, \eta_{bN}$. Average values $\alpha a$, $\alpha b$, $\alpha c$, . . . of the shape data, average values $\beta a$, $\beta b$, $\beta c$, . . . of the cross sectional area data, and average values $\eta a$, $\eta b$, $\eta c$, . . . of the frequency data are obtained for the respective denominations a, b, c, . . . according to the following equations:

$$\alpha a=(\alpha_{a1}+\alpha_{a2}+\alpha_{a3}+\ldots+\alpha_{aN})/N$$

$$\alpha b=(\alpha_{b1}+\alpha_{b2}+\alpha_{b3}+\ldots+\alpha_{bN})/N$$

$$\alpha c=(\alpha_{c1}+\alpha_{c2}+\alpha_{c3}+\ldots+\alpha_{cN})/N$$

$$\beta a=(\beta_{a1}+\beta_{a2}+\beta_{a3}+\ldots+\beta_{aN})/N$$

$$\beta b=(\beta_{b1}+\beta_{b2}+\beta_{b3}+\ldots+\beta_{bN})/N$$

$$\beta c=(\beta_{c1}+\beta_{c2}+\beta_{c3}+\ldots+\beta_{cN})/N$$

$$\eta a=(\eta_{a1}+\eta_{a2}+\eta_{a3}+\ldots+\eta_{aN})/N$$

$$\eta b=(\eta_{b1}+\eta_{b2}+\eta_{b3}+\ldots+\eta_{bN})/N$$

$$\eta c=(\eta_{c1}+\eta_{c2}+\eta_{c3}+\ldots+\eta_{cN})/N$$

Assume that the average values $\alpha a$, $\beta a$, and $\eta a$ associated with a specific denomination (to be referred to as a reference denomination hereinafter) a are standard discriminating coefficient data as reference data. Ratios $(\alpha b/\alpha a)$, $(\beta b/\beta a)$, $(\eta b/\eta a)$, $(\alpha c/\alpha a)$, $(\beta c/\beta a)$, $(\eta c/\eta a)$, . . . of the average values $\alpha b$, $\beta b$, $\eta b$, $\alpha c$, $\beta c$, $\eta c$, . . . of the other denominations b, c, . . . to the average values $\alpha a$, $\beta a$, and $\eta a$ are obtained as standard discriminating coefficient data of the other denominations b, c, . . . Note that these standard discriminating coefficient data are not created in units of coin detecting apparatuses but are created by using a specific coin detecting apparatus, and are equally stored in the ROM 250 of each of the remaining coin detecting apparatuses.

Gauge data which are created when each coin detecting apparatus is actually installed and subjected to initial adjustment are stored in the EEPROM 260. Such gauge data are created in accordance with the following procedure. The coin detecting apparatus is energized first, and a coin of the same denomination as the reference denomination a is inserted in the sensor portion. Upon reception of reference level data $\gamma 1$ (corresponding to the maximum amplitude H0 in FIG. 24D), obtained while no coin to be detected is inserted in the coils 90 and 93, through the processing unit 230, the discriminator 240 calculates the ratios of the standard discriminating coefficient data $\beta a$, $\alpha a$, and $\eta a$ respectively associated with the cross sectional area, shape, and frequency features of the reference denomination a, which are stored in the ROM 250 in advance, to the reference level data $\gamma 1$. The discriminator 240 then causes the EEPROM 260 to store gauge data $G\alpha a=\alpha a/\gamma 1$, $G\beta a=\beta a/\gamma 1$, and $G\eta a=\eta a/\gamma 1$ respectively associated with the shape, cross sectional area, and frequency features of the denomination a, as calculation results.

A coin detecting operation of the coin detecting apparatus having the above arrangement will be described next.

When no coin to be detected passes through the coils 90 and 93, the processing unit 230 of the compensation control unit 220 repeats an operation of holding latest reference level data $\gamma 2$ at the current time point, which corresponds to the maximum amplitude H0 shown in FIG. 24D, on the basis of the amplitude data Dax and Day and the frequency data Dfx and Dfy transferred from the detecting circuits X and Y. When a coin to be detected passes through the coils 90 and 93, the processing unit 230 obtains the latest reference level data $\gamma 2$, obtained immediately before the passage of the coin, shape data $\alpha$, cross sectional area data $\beta$, and frequency data $\eta$. Thereafter, the processing unit 230 reads the gauge data $G\alpha a$, $G\beta a$, and $G\eta a$ from the EEPROM 260, and further performs arithmetic operations according to the following equations, thereby calculating discrimination reference data $R\alpha a$, $R\beta a$, and $R\eta a$ representing the shape, cross sectional area, and frequency features of the reference denomination a:

$$R\beta a=G\beta a\times\gamma 2$$

$$R\alpha a=G\alpha a\times\gamma 2$$

$$R\eta a=G\eta a\times\gamma 2$$

In addition, the discrimination reference data $R\alpha a$, $R\beta a$, and $R\eta a$ obtained by these calculations are multiplied by the standard discriminating coefficient data of the other denominations b, c, . . . according to the following equations, thereby calculating discrimination reference data $R\alpha b$, $R\beta b$, $R\eta b$, $R\alpha c$, $R\beta c$, $R\eta c$, . . . representing the shape, cross sectional area, and frequency features of the denominations b, c, . . . .

For the denomination b, the equations are:

$$R\beta b=(\beta b/\beta a)\times R\beta a$$

$$R\alpha b=(\alpha b/\alpha a)\times R\alpha a$$

$$R\eta b=(\eta b/\eta a)\times R\eta a$$

For the denomination c, the equations are:

$$R\beta c=(\beta c/\beta a)\times R\beta a$$

$$R\alpha c=(\alpha c/\alpha a)\times R\alpha a$$

$$R\eta c=(\eta c/\eta a)\times R\eta a$$

The discrimination reference data of the remaining denominations are calculated in the same manner as described above. As is apparent from FIG. 26, it should be noted that the discrimination reference data Rαa, Rβa, Rηa, Rαb, Rβb, Rηb, Rαc, Rβc, Rηc, . . . have proportional relations with the average values αa, βa, ηa, αb, βb, ηb, αc, βc, ηc, . . . of the shape, cross sectional area, and frequency features of the respective denominations a, b, c, . . . and a constant value (γ2/γ1).

The discriminator 240 compares shape data α, cross sectional area data β, and frequency data η, which are obtained by actual measurement, with the discrimination reference data Rαa, Rβa, Rηa, Rαb, Rβb, Rηb, Rαc, Rβc, Rηc, . . . , and discriminates a denomination exhibiting high consistency with respect to all the features, i.e., the shape, cross sectional area, and frequency features, thereby outputting discrimination result data Q indicating the denomination of the coin which has passed through the sensor portion.

In this case, the discrimination reference data are created on the basis of the standard discriminating data, the gauge data, and the reference level data γ2 obtained when coin detection processing is actually performed, and the denomination of the coin which has actually passed through the sensor portion is discriminated on the basis of the discrimination reference data. Such an operation is performed because the coin detection characteristics of the coin detecting apparatus change under the influence of changes in external environment at the location of the apparatus or changes over time. If discrimination is performed by using certain fixed discrimination data as reference data, a coin detection error may occur, resulting in a decrease in coin detection precision.

Figures 25, 26:
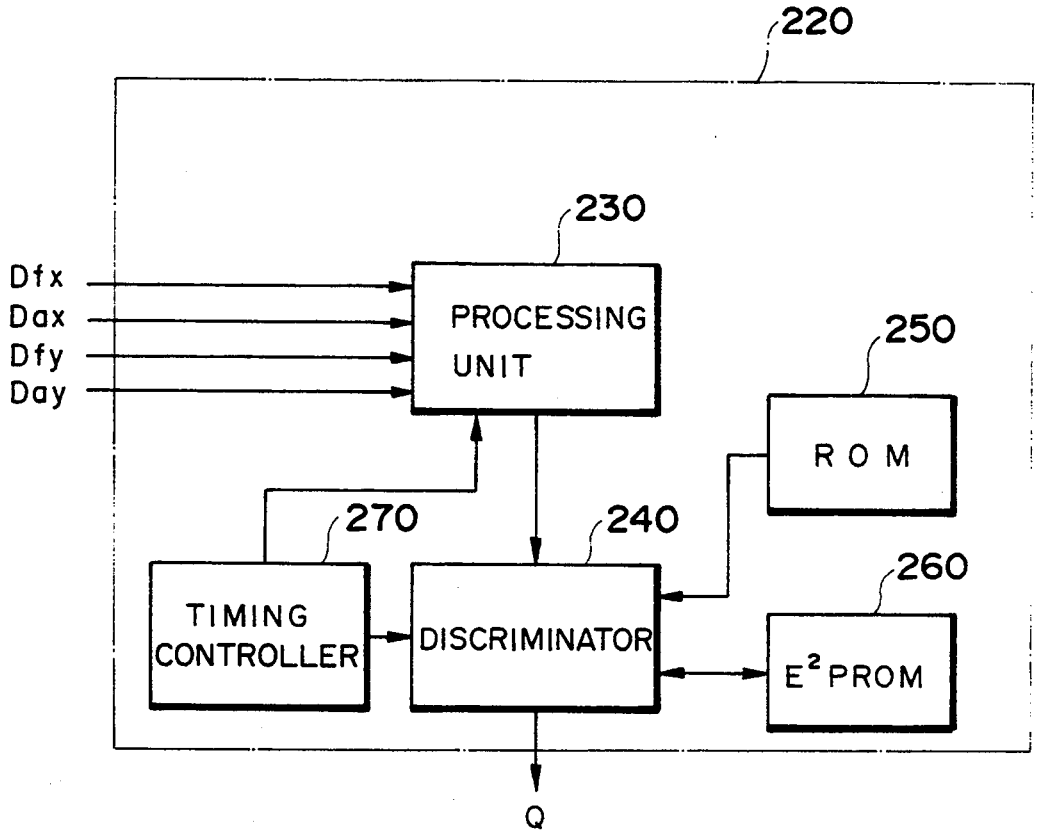
FIG. 25 is a block diagram showing the arrangement of a compensation control unit for performing compensation processing and coin discrimination processing on the basis of data output from the detecting circuits.
FIG. 26 is a table showing standard discriminating coefficient data stored in a ROM arranged in the compensation control unit.

As shown in FIG. 26, the standard discriminating coefficient data stored in the ROM 250 in advance are the ratios of the reference level data γ to discrimination reference data (corresponding to the average values αa, βa, ηa, αb, βb, ηb, αc, βc, ηc, . . . of the respective denominations) in an ideal state. The gauge data shown in FIG. 27 are the ratios of the discrimination reference data of a predetermined reference denomination to the reference level data γ1 obtained when adjustment is performed. Since the reference level data γ2 obtained in actual coin detection processing has correlation with a change in coin detection characteristic, the reference level data γ2 is multiplied by the gauge data to obtain the discrimination reference data Rβa, Rαa, and Rηa associated with the reference denomination a with the change (γ2/γ1) in coin detection characteristic being compensated. In addition, by multiplying the compensated discrimination reference data Rβa, Rαa, and Rηa of the reference denomination by the standard discriminating coefficient data of the other denominations, compensated discrimination reference data Rαb, Rβb, Rηb, Rαc, Rβc, and Rηc, . . . of the other denominations are obtained, thereby canceling out the change in coin detection characteristic in effect. That is, since the change (γ2/γ1) in coin detection characteristic has correlation with changes in the cross sectional area, shape, and frequency features of a coin to be detected, discrimination reference data with a change in coin detection characteristic being compensated can be obtained by performing the above-described arithmetic operations.

Figure 29:
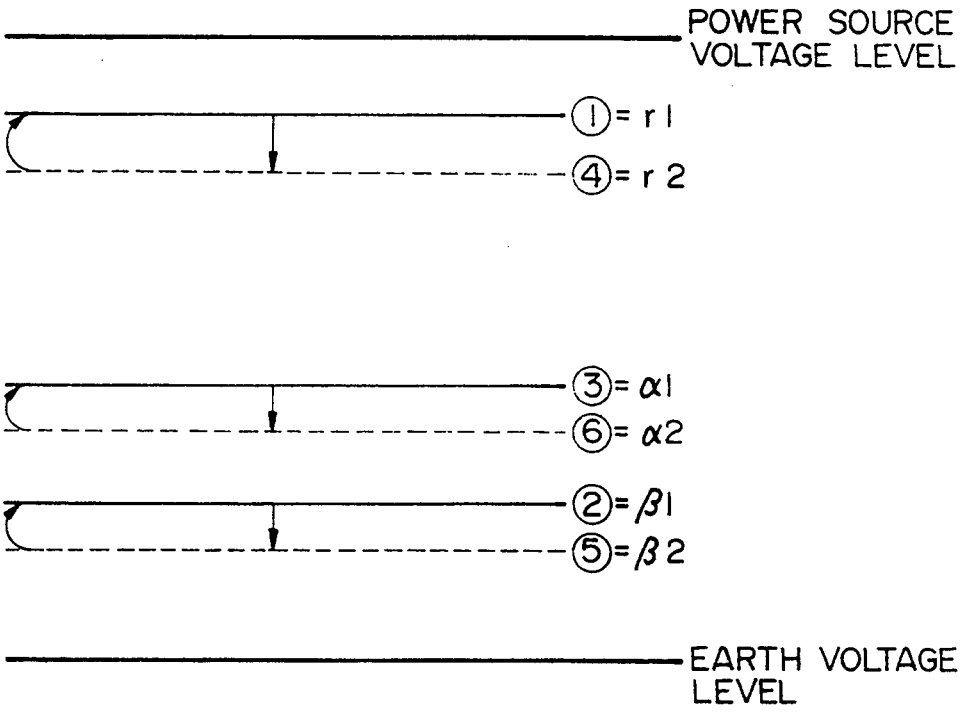
FIG. 29 is a view for explaining the principle of compensation for coin detection characteristics according to the fourth embodiment.
Figure 30:
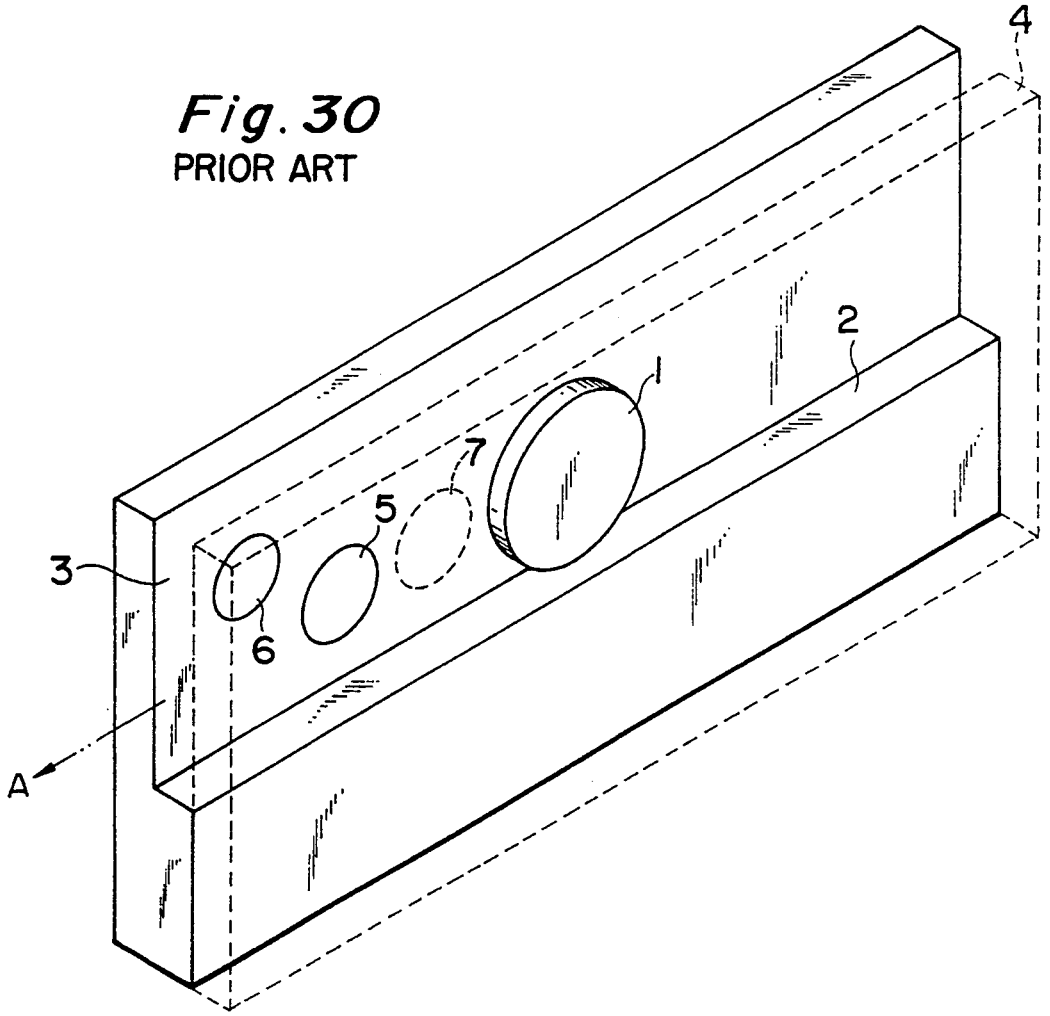
Fig. 30 PRIOR ART
FIG. 30 is an explanatory diagram showing schematically a structure of a conventional coin detecting apparatus.
Figure 31:
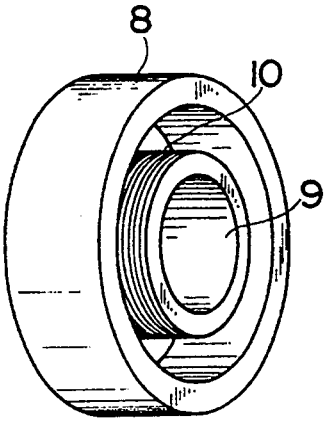
Fig. 31 PRIOR ART
FIG. 31 is a perspective view showing a structure of a conventional detecting sensor.
Figure 32:
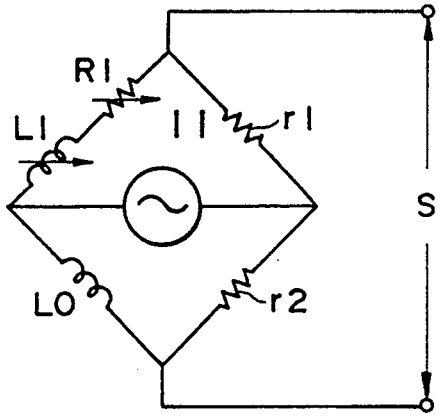
Fig. 32 PRIOR ART
FIG. 32 is a circuit diagram showing a detecting circuit using the conventional detecting sensor.
Figure 33:
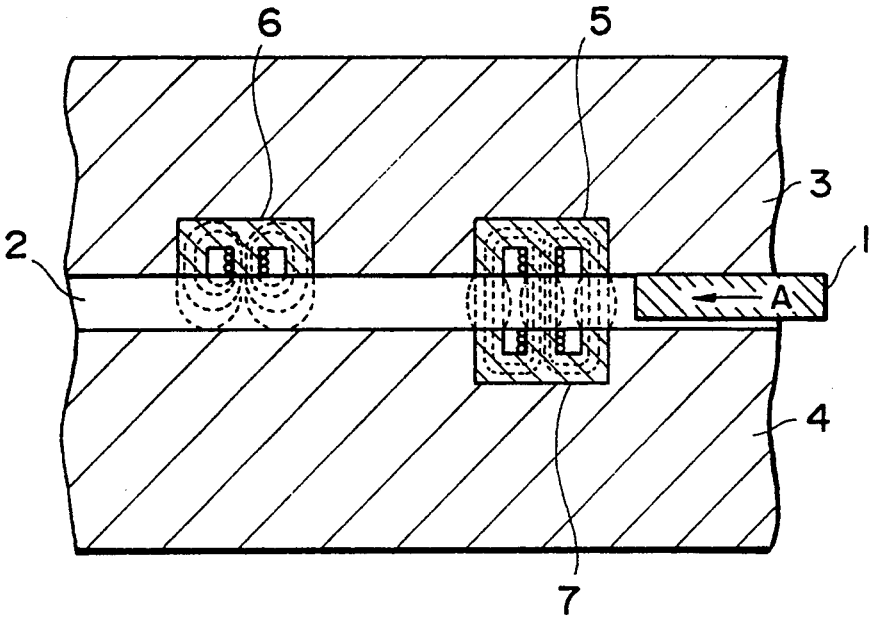
Fig. 33 PRIOR ART
FIG. 33 is a constructional explanatory diagram showing a structure of a conventional coin detecting apparatus from the upper side.
Figure 34A:
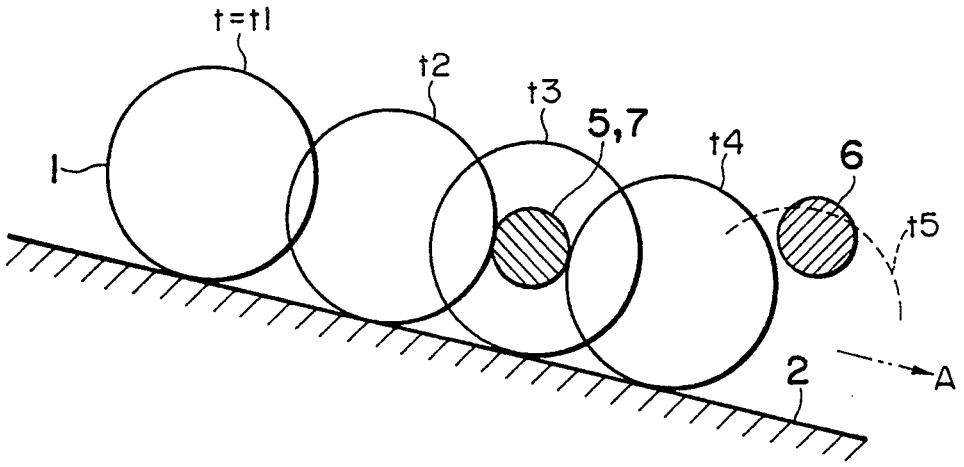
Fig. 34A PRIOR ART
FIG. 34A is an explanatory diagram for explaining the operation of the conventional coin detecting apparatus.
Figure 34B:
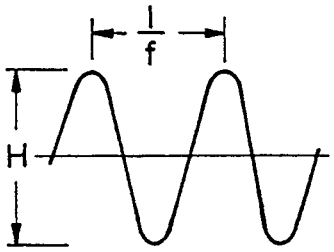
Fig. 34B PRIOR ART
FIG. 34B is a waveform diagram of a signal S at a time point t1 in FIG. 34A.
Figure 34C:
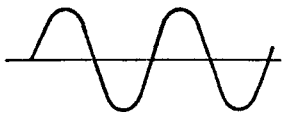
Fig. 34C PRIOR ART
FIG. 34C is a waveform diagram of the signal S at a time point t2 in FIG. 34A.
Figure 34D:
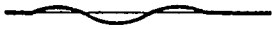
Fig. 34D PRIOR ART
FIG. 34D is a waveform diagram of the signal S at a time point t3 in FIG. 34A.

This principle will be further described with reference to FIG. 29. Referring to FIG. 29, reference numeral ① denotes the value of the reference level data γ1 at the time of adjustment; ②, the value of cross sectional area data β1 at the time of adjustment; and ③, the value of shape data α1 at the time of adjustment. Assume that these values respectively change to the reference level data γ2 denoted by reference numeral ④, cross sectional data β2 denoted by reference numeral ⑤, and shape data α2 denoted by reference numeral ⑥. In this case, if the above-described arithmetic operations are performed, the cross sectional data β2 and the shape data α2 are weighted by the ratio of the reference level data γ1 and γ2. As a result, the cross sectional data β2 and the shape data α2 are relatively compensated to coincide with the cross sectional data β1 and the shape data α1 as reference data. In addition, the frequency discrimination data is also compensated in the same manner. Since the change in coin detection characteristic is compensated by these arithmetic operations in an actual coin detecting operation, coin detection/discrimination can be realized in a substantially ideal state.

As described above, according to the fourth embodiment, since the ratio of the reference level data γ1, obtained at the time of adjustment or the like, to the reference level data γ2, obtained in an actual coin detecting operation, has correlation with a change in coin detection characteristic due to changes over time and the like, the reference level data γ2 is weighted by standard discriminating coefficient data, thereby compensating for an error in discrimination data in the actual coin detecting operation. Coin detection/discrimination is performed on the basis of the compensated discrimination data. Therefore, the apparatus is free from the influences of changes in external environment and changes over time, and coin detection/discrimination can be performed in substantially constant discrimination conditions.

In the fourth embodiment, as shown in FIG. 27, by using the gauge data of a specific reference denomination, the discrimination reference data of the remaining denominations are obtained. However, the present invention is not limited to this. For example, the gauge data of all the denominations may be stored in the EEPROM 260 in advance so that the discrimination reference data of the respective denominations can be directly obtained by multiplying the respective gauge data by the reference level data γ2 obtained in an actual coin detecting operation. More specifically, in place of the gauge data of the specific denomination shown in FIG. 27, gauge data Gβa, Gαa, Gηa, Gβb, Gαb, Gηb, Gβc, Gαc, Gηc, . . . associated with all the denominations a, b, c, . . . shown in FIG. 28 may be stored in the EEPROM 260. In this case, discrimination reference data Rβa, Rαa, Rηa, Rβb, Rαb, Rηb, Rβc, Rαc, Rηc, . . . of all the denominations a, b, c, . . . are directly obtained by multiplying these gauge data by the reference level data $\gamma 2$ obtained in an actual coin detecting operation. In addition, characteristic data $\beta$, $\alpha$, and $\eta$ of a coin to be detected, obtained in an actual coin detecting operation, are compared with these discrimination reference data to discriminate a denomination exhibiting the highest consistency as the denomination of the coin.

According to the fourth embodiment, as described above, the amplitude of an AC signal which is generated in the above-described oscillator in a state wherein no coin to be detected is present at a certain reference time point is set as the first reference level data $\gamma 1$, whereas the amplitude of an AC signal which is generated in the LC oscillator in a state wherein no coin to be detected is present in an actual coin detecting operation is set as the second reference level data $\gamma 2$. Since there is correlation between the ratio of these data and a change in coin detection characteristic due to the influence of an external environment on the coin detecting apparatus or changes over time, discrimination reference data with the change in coin detection characteristic being canceled can be obtained by weighting (multiplying) standard discriminating coefficient data or gauge data by the reference level data $\gamma 2$ obtained in the actual coin detecting operation. The discrimination reference data is compared with the feature data of the coin to be detected, obtained when the coin passes through the annular coils of the sensor portion in the actual coin detecting operation, so as to discriminate a denomination exhibiting the highest consistency as the denomination of the coin. Therefore, coin detection/-discrimination can be always realized in substantially constant discrimination conditions without being influenced by an external environment or by changes over time, thereby providing an excellent coin detecting apparatus free from a decrease in coin detection precision.

The fourth embodiment is designed to increase the coin detection precision of the coin detecting apparatus of the second embodiment which has the two independent sensor portions. However, the present invention is not limited to this. That is, the principle described with reference to the fourth embodiment can be applied to the coin detecting apparatus of the third embodiment in which the single coil constituted by a plurality of winding portions is used as a sensor portion.

What is claimed is:

1. An apparatus for discriminating a metal body, said apparatus comprising:

a plurality of self-oscillators, each having an annular coil serving an inductor for causing resonance;

a sensor portion having a structure in which the annular coils of said self-oscillators are arranged at a predetermined interval, and a target coin is caused to pass through hollow portions of the respective annular coils; and discriminating means for detecting specific changes in frequency and amplitude of an AC signal, as feature data of the coin, which changes occur with changes in impedance and inductance of each of the annular coils due to the influence of an eddy current generated in the coin by lines of magnetic force from each of the annular coils when the coin passes through the hollow portion of each of the annular coils, and discriminating a denomination of the coin on the basis of the feature data, said discriminating means including first storage means for storing data indicating ratios of feature data of all target denominations, except for a specific denomination, to feature data of the specific denomination, and storing the feature data of the specific denomination as standard discriminating coefficient data for each denomination, second storage means for storing ratios of an amplitude of an AC signal, generated in said self-oscillator in a state in which no target coin is present at a given reference time point, to the feature data of the specific denomination, as gauge data, and compensation control means for obtaining discrimination reference data of the specific denomination by calculating a product of amplitude data of an AC signal, generated in said self-oscillator in a state in which no target coin is present in an actual coin detecting operation, and the gauge data, obtaining standard discriminating data of the other denominations by calculating products of the discrimination reference data of the specific denomination and the standard discriminating coefficient data of the other denominations, and comparing feature data of a target coin, obtained when the coin passes through the annular coils of said sensor portion, with the discrimination reference data of the specific denomination and the discrimination reference data of the other denominations, thereby discriminating a denomination whose discrimination reference data exhibits highest consistency, as a denomination of the coin.

2. An apparatus for discriminating a metal body, said apparatus comprising:

a plurality of self-oscillators, each having an annular coil serving an inductor for causing resonance;

a sensor portion having a structure in which the annular coils of said self-oscillators are arranged at a predetermined interval, and a target coin is caused to pass through hollow portions of the respective annular coils; and discriminating means for detecting specific changes in frequency and amplitude of an AC signal, as feature data of the coin, which changes occur with changes in impedance and inductance of each of the annular coils due to the influence of an eddy current generated in the coin by lines of magnetic force from each of the annular coils when the coin passes through the hollow portion of each of the annular coils, and discriminating a denomination of the coin on the basis of the feature data, said discriminating means including storage means for storing ratios of an amplitude of an AC signal, generated in said self-oscillator in a state in which no target coin is present at a given reference time point, to characteristic data of all denominations, as gauge data of the respective denominations, and compensation control means for obtaining discrimination reference data of the respective denominations by calculating products of amplitude data of an AC signal, generated in said self-oscillator in a state in which no target coin is present in an actual coin detecting operation, and the gauge data of the respective denominations, and comparing feature data of a target coin, obtained when the coin passes through the annular coils of said sensor portion, with the discrimination reference data, thereby discriminating a denomination whose discrimination reference data exhibits highest consistency, as a denomination of the coin.

3. An apparatus for discriminating a metal body, said apparatus comprising:

a sensor portion including:

a coil having a plurality of winding portions electrically connected in series and formed at a predetermined interval, said coil allowing a target coin to pass through hollow portions of said winding portions;

a self-oscillator for generating an oscillation signal in cooperation with said coil; and a structure in which the winding portions of said self-oscillators are arranged at a predetermined interval, and a target coin is caused to pass through hollow portions of the respective winding portions; and discriminating means for detecting specific changes in frequency and amplitude of an AC signal, as feature data of the coin, which changes occur with changes in impedance and inductance of each of the winding portions due to the influence of an eddy current generated in the coin by lines of magnetic force from each of the winding portions when the coin passes through the hollow portion of each of the winding portions, and discriminating a denomination of the coin on the basis of the feature data, said discriminating means including first storage means for storing data indicating ratios of feature data of all target denominations, except for a specific denomination, to feature data of the specific denomination, and storing the feature data of the specific denomination as standard discriminating coefficient data for each denomination, second storage means for storing ratios of an amplitude of an AC signal, generated in said self-oscillator in a state in which no target coin is present at a given reference time point, to the feature data of the specific denomination, as gauge data, and compensation control means for obtaining discrimination reference data of the specific denomination by calculating a product of amplitude data of an AC signal, generated in said self-oscillator in a state in which no target coin is present in an actual coin detecting operation, and the gauge data, obtaining standard discriminating data of the other denominations by calculating products of the discrimination reference data of the specific denomination and the standard discriminating coefficient data of the other denominations, and comparing feature data of a target coin, obtained when the coin passes through the winding portions of said sensor portion, with the discrimination reference data of the specific denomination and the discrimination reference data of the other denominations, thereby discriminating a denomination whose discrimination reference data exhibits highest consistency, as a denomination of the coin.

4. An apparatus for discriminating a metal body, said apparatus comprising:

a sensor portion including;

a coil having a plurality of winding portions electrically connected in series and formed at a predetermined interval, said coil allowing a target coin to pass through hollow portions of said winding portions;

a self-oscillator for generating an oscillation signal in cooperation with said coil; and a structure in which the winding portions of said self-oscillators are arranged at a predetermined interval, and a target coin is caused to pass through hollow portions of the respective winding portions; and discriminating means for detecting specific changes in frequency and amplitude of an AC signal, as feature data of the coin, which changes occur with changes in impedance and inductance of each of the winding portions due to the influence of an eddy current generated in the coin by lines of magnetic force from each of the winding portions when the coin passes through the hollow portion of each of the winding portions, and discriminating a denomination of the coin on the basis of the feature data, said discriminating means including storage means for storing ratios of an amplitude of an AC signal, generated in said self-oscillator in a state in which no target coin is present at a given reference time point, to feature data of all denominations, as gauge data of the respective denominations, and compensation control means for obtaining discrimination reference data of the respective denominations by calculating products of amplitude data of an AC signal, generated in said self-oscillator in a state in which no target coin is present in an actual coin detecting operation, and the gauge data of the respective denominations, and comparing feature data of a target coin, obtained when the coin passes through the winding portions of said sensor portion, with the discrimination reference data, thereby discriminating a denomination whose discrimination reference data exhibits highest consistency, as a denomination of the coin.

* * * * *